US011255036B2

(12) United States Patent
Ikeda et al.

(10) Patent No.: US 11,255,036 B2
(45) Date of Patent: Feb. 22, 2022

(54) WASHING MACHINE

(71) Applicant: Samsung Electronics Co., Ltd., Suwon-si (KR)

(72) Inventors: Izumi Ikeda, Yokohama (JP); Katsuyuki Shimakage, Yokohama (JP); Yukinori Nakagawa, Yokohama (JP); Yasumasa Nagasaki, Yokohama (JP); Hiroshi Watanabe, Yokohama (JP); Tukasa Ida, Yokohama (JP); Kiyonobu Yoshida, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 76 days.

(21) Appl. No.: 16/317,523

(22) PCT Filed: Jul. 28, 2017

(86) PCT No.: PCT/KR2017/008159

§ 371 (c)(1),
(2) Date: Jan. 11, 2019

(87) PCT Pub. No.: WO2018/021871

PCT Pub. Date: Feb. 1, 2018

(65) Prior Publication Data

US 2019/0257020 A1 Aug. 22, 2019

(30) Foreign Application Priority Data

Jul. 28, 2016 (JP) ..... JP2016-148896
Aug. 23, 2016 (JP) ..... JP2016-162817
(Continued)

(51) Int. Cl.
*D06F 37/40* (2006.01)
*D06F 21/04* (2006.01)
(Continued)

(52) U.S. Cl.
CPC ..... *D06F 37/40* (2013.01); *D06F 17/10* (2013.01); *D06F 21/04* (2013.01); *D06F 23/02* (2013.01);
(Continued)

(58) Field of Classification Search
CPC ..... D06F 17/10; D06F 21/04; D06F 23/02; D06F 37/04; D06F 37/30; D06F 37/304;
(Continued)

(56) References Cited

U.S. PATENT DOCUMENTS 3,184,934 A 5/1965 Smith
5,720,065 A 2/1998 Myers et al.
(Continued)

FOREIGN PATENT DOCUMENTS

CN 102025314 B 12/2012
CN 104911861 A 9/2015
(Continued)

OTHER PUBLICATIONS

Machine translation of WO-2016080770-A1 to Kim et al., dated May 26, 2016. (Year: 2016).*
(Continued)

*Primary Examiner* — Joseph L. Perrin

(57) ABSTRACT

A compact washing machine capable of improving detergency or reducing a washing time is provided. A drum 30 may be rotatably installed in a tub 20 installed in the inside of a housing 10 in the state in which an opening 12 is toward an opening of the drum 30. A pulsator 40 having a protrusion 45 extending in a radial direction may be rotatably installed on a bottom of the drum 30. During washing operation, a controller 60 may control a driving device 50 to rotate the pulsator 40 and the drum 30 in opposite directions.

13 Claims, 33 Drawing Sheets

(30) Foreign Application Priority Data

| | | |
|---|---|---|
| Aug. 29, 2016 | (JP) | JP2016-166774 |
| Aug. 31, 2016 | (JP) | JP2016-168935 |
| Nov. 21, 2016 | (JP) | JP2016-226345 |
| Apr. 5, 2017 | (JP) | JP2017-075230 |

(51) Int. Cl.

| | |
|---|---|
| ***D06F 23/02*** | (2006.01) |
| ***D06F 17/10*** | (2006.01) |
| ***D06F 37/30*** | (2020.01) |
| ***D06F 103/46*** | (2020.01) |
| ***D06F 105/48*** | (2020.01) |
| ***D06F 105/46*** | (2020.01) |
| ***D06F 37/04*** | (2006.01) |
| *D06F 37/36* | (2006.01) |
| *D06F 37/38* | (2006.01) |

(52) U.S. Cl.
CPC ..... *D06F 37/04* (2013.01); *D06F 37/304* (2013.01); *D06F 37/30* (2013.01); *D06F 37/36* (2013.01); *D06F 37/38* (2013.01); *D06F 2103/46* (2020.02); *D06F 2105/46* (2020.02); *D06F 2105/48* (2020.02)

(58) Field of Classification Search
CPC ..... D06F 37/36; D06F 37/38; D06F 37/40; D06F 2103/46; D06F 2105/46; D06F 2105/48; H02K 16/02
See application file for complete search history.

(56) References Cited

U.S. PATENT DOCUMENTS

| | | | | |
|---|---|---|---|---|
| 2004/0119373 | A1* | 6/2004 | Akatsu | H02K 7/083 310/266 |
| 2006/0042022 | A1* | 3/2006 | Kim | D06F 37/304 8/159 |
| 2010/0050702 | A1* | 3/2010 | Kim | H02K 21/16 68/23 R |
| 2010/0242549 | A1* | 9/2010 | Hosoito | D06F 37/306 68/139 |
| 2013/0160499 | A1* | 6/2013 | Kim | D06F 37/304 68/12.16 |
| 2015/0225885 | A1* | 8/2015 | Kim | D06F 37/06 68/140 |
| 2015/0252507 | A1* | 9/2015 | Kim | D06F 37/304 68/23.6 |
| 2016/0010257 | A1 | 1/2016 | Kim et al. | |
| 2016/0130739 | A1* | 5/2016 | Song | D06F 37/40 8/137 |
| 2016/0168775 | A1* | 6/2016 | Kim | H02K 7/116 68/133 |
| 2016/0201246 | A1* | 7/2016 | Song | D06F 37/40 8/137 |
| 2016/0376741 | A1* | 12/2016 | Kim | H02K 1/148 310/90 |
| 2017/0073868 | A1* | 3/2017 | Lv | D06F 17/10 |
| 2017/0268150 | A1* | 9/2017 | Lv | D06F 37/304 |

FOREIGN PATENT DOCUMENTS

| | | | | | |
|---|---|---|---|---|---|
| EP | 1630278 | A2 | | 3/2006 | |
| JP | 2003-299281 | A | | 10/2003 | |
| JP | 2016-049265 | A | | 4/2016 | |
| KR | 1020050087342 | A | * | 8/2005 | |
| KR | 10-2006-0020266 | A | | 3/2006 | |
| KR | 10-0690701 | B1 | | 3/2007 | |
| KR | 10-2011-0027569 | A | | 3/2011 | |
| KR | 10-1169268 | B1 | | 8/2012 | |
| KR | 10-2013-0074151 | A | | 7/2013 | |
| KR | 10-2016-0059558 | A | | 5/2016 | |
| WO | 2013100440 | A1 | | 7/2013 | |
| WO | WO-2016080770 | A1 | * | 5/2016 | D06F 37/40 |

OTHER PUBLICATIONS

Machine translation of KR-1020050087342-A to Jo et al. (Year: 2005).*

Partial Supplementary European Search Report regarding Application No. 17834812.4, dated Jun. 21, 2019, 14 pages.

Supplementary European Search Report dated Oct. 24, 2019 in connection with European Patent Application No. 17 83 4812, 12 pages.

ISA/KR, "International Search Report and Written Opinion of the International Searching Authority," International Application No. PCT/KR2017/008159, dated Nov. 7, 2017, 13 pages.

Examination report in connection with Indian Application No. 201917007704 dated Jul. 1, 2020, 7 pages.

Notice of Preliminary Rejection dated Sep. 14, 2021, in connection with Korean Application No. 10-2018-7030109, 9 pages.

* cited by examiner

WASHING MACHINE

CROSS-REFERENCE TO RELATED APPLICATIONS

This application is a 371 National Stage of International Application No. PCT/KR2017/008159, filed Jul. 28, 2017, which claims priority to Japanese Patent Application No. 2016-148896, filed Jul. 28, 2016, Japanese Patent Application No. 2016-162817, filed Aug. 23, 2016, Japanese Patent Application No. 2016-166774, filed Aug. 29, 2016, Japanese Patent Application No. 2016-168935, filed Aug. 31, 2016, Japanese Patent Application No. 2016-226345, filed Nov. 21, 2016, and Japanese Patent Application No. 2017-075230, filed Apr. 5, 2017, the disclosures of which are herein incorporated by reference in their entireties.

BACKGROUND

1. Field

The present disclosure relates to a washing machine.

2. Description of Related Art

Household washing machines are largely classified into top loading type washing machines and front loading type washing machines (drum type washing machines).

Generally, in the top loading type washing machines, the drum located in the inside of the tub positioned vertically accommodates laundry together with a sufficient amount of washing water, and washes the laundry by water streams generated by stirring the washing water with a pulsator blades). This washing method is called "kneading washing".

Although recently-developed top loading type washing machines use a smaller amount of washing water than typical washing machines, drum type washing machines are advantageous in view of water saving due to the washing method.

That is, the drum type washing machines accommodate laundry and a small amount of washing water in the drum located in the inside of the tub positioned horizontally, and wash the laundry through mechanical operation of rotating the drum to raise and drop the laundry. This washing method is called "beating washing". Accordingly, the drum type washing machines use a small amount of washing water since the amount of washing water is less important, compared to the top loading type washing machines.

When laundry is washed with a small amount of washing water, raising the mobility of laundry to make the entire laundry contact washing water equally and increasing mechanical actions are important in improving washing power and reducing a washing time. Particularly, since European and American drum type washing machines generally use less washing water (only just enough washing water to cover laundry on the surface) than Japanese drum washing machines, the above-described two factors are becoming more important.

Meanwhile, since the magnitude of mechanical actions of drum type washing machines is caused by a fall of laundry and decided by the internal diameter (generally, set by the specification of the washing machine) of the drum, increasing the magnitude of mechanical actions is not easy. Although a method of raising the rpm of the drum to increase the frequency of falls can be considered, increasing the rpm makes laundry stuck on the drum so that the laundry does not fall.

Furthermore, recently, large washing machines are widely used to wash a large amount of laundry. However, when a large amount of laundry is put in the drum, it becomes different to make the laundry fall, so that sufficient mechanical power is not applied to the laundry. Therefore, a method of increasing a time for which laundry is immersed in washing water to secure washing performance, that is, a method of increasing a washing time is used.

Accordingly, drum type washing machines designed to improve the mobility of laundry, like top loading type washing machines, have been proposed (Patent Documents 1 and 2).

In the drum type washing machines disclosed in Patent Documents 1 and 2, the drum is configured with a main drum and a sub drum having a shorter side wall than the main drum, wherein the sub drum is installed in the inside of the main drum, while overlapping with the main drum. The washing machines rotate the main drum and the sub drum at different rpms or in different rotation directions to generate rotations in a vertical-axis direction by variations in rpm at the border between the main drum and the sub drum, as well as rotations in a horizontal-axis direction accompanied by beating washing, thereby causing laundry to move in three dimensions.

A washing machine including a motor for rotating a rotation tub and a stirring body on the same rotation shaft through a shaft of a dual shaft structure is disclosed, for example, in Patent Document 3.

The washing machine includes the motor (dual motor) in which an inner rotor and an outer rotor are positioned in the inside and outside of a stator. Also, the washing machine uses a shaft (a double shaft) of a dual shaft structure connected to the inner rotor and the outer rotor. The dual shaft is configured with a hollow outer shaft connected to the rotation tub, and an inner shaft rotatably inserted in the outer shaft and connected to the stirring body. The inner shaft is fixed at the outer rotor, and the outer shaft is fixed at the inner rotor.

A drum type washing machine in which a boosting circuit is installed in an inverter circuit for driving a motor in order to prevent a supply voltage from dropping during dehydrating operation or drying operation requiring great power is known (Patent Document 4).

The drum type washing machine of Patent Document 4 includes a drum motor for rotating the drum, as a motor having high power consumption, and a compressor motor used for drying air. The drum type washing machine raises voltages that are supplied to an inverter for the drum motor and an inverter for the compressor motor, as necessary, to thus control the motors stably.

Patent Document 1: US2013/0111676 A1

Patent Document 2: Japanese Patent Publication No 2014-530741

Patent Document 3: Japanese Laid-open Patent Application No. 11-276777

Patent Document 4: Japanese Patent No. 5097072

SUMMARY

In the washing machines according to Patent Documents 1 and 2, a force generating rotations in the vertical-axis direction is applied only to laundry collected in a middle bottom in front-back direction of the drum, corresponding to the border of the main drum and the sub drum, among laundry collected in the lower portion of the drum, and accordingly, laundry located in the front or rear portion of the drum or laundry located above the laundry tend to remain without moving.

Although the washing machines of Patent Documents 1 and 2 facilitate movements of laundry by installing a plurality of lifters (stirring blades) extending in the front-back direction on the inner circumferential wall of the main drum or the sub drum, there is probability that lifters located around the border damage or bite the laundry. Therefore, the lifters need to be spaced a predetermined distance, and there is limitation in facilitating rotations in the vertical-axis direction through the lifters. Accordingly, laundry still tends to remain without moving.

Also, since the relatively large sub drum as well as the main drum also needs to rotate, the structure of the drum or the driving mechanism become complicated and enlarged, resulting in an increase of running cost.

Also, since the sub drum is positioned in the inside of the main drum, it is necessary to make a predetermined gap between the main drum and the sub drum. Therefore, a large drum is needed to correspond to a large capacity washing machine. However, such a large drum increases the product size, has difficulties in installation, and causes high cost.

Accordingly, an object of the present disclosure provides a compact washing machine capable of providing strong mechanical power and great mobility to laundry through a relatively simple structure by adopting operations of a new mechanism, and capable of improving washing power or reducing a washing time.

The present disclosure related to a washing machine.

The washing machine may include: a housing having an opening through which laundry is put into or taken out of the housing; a tub disposed in the inside of the housing; a drum rotatably positioned in the inside of the tub in the state in which an opening of the drum is toward the opening of the housing; and a pulsator rotatably positioned on a bottom of the drum and having a protrusion extending in a radial direction; a driving device configured to rotate the drum and the pulsator; and a controller configured to control the driving device, wherein during washing operation, the controller controls the driving device to rotate the drum and the pulsator relative to each other.

According to the washing machine, when a small amount of washing water is used, for example, such that some of laundry is immersed in the washing water, mechanical power of the drum may be combined with mechanical power of the protrusions of the pulsator rotating relative to the drum to apply the combined mechanical power to the laundry. That is, when the rpm of the drum is set to a great value and driving is performed such that laundry is slightly stuck by a centrifugal force, the laundry is slightly stuck on the drum if the pulsator is set to rotate relative to the drum, and accordingly, the protrusions beat the laundry to transfer mechanical power to the laundry.

Also, there is no need for making an unnecessary gap between the pulsator and the drum, and actually, clothes enter the gap to improve washing performance. Therefore, it may be possible to increase the capacity of the drum in correspondence to a large capacity washing machine.

In the case of a drum type washing machine, laundry to which mechanical power is transferred is separated from the drum to collide with the rotating pulsator to again receive mechanical power so as to be pushed toward the front direction. At this time, the laundry moves while pulling the neighboring laundry. Accordingly, effects of typical beating washing and rubbing by the movement of the laundry can be obtained. Also, since the laundry is mixed, stains may be reduced.

In the case of a top loading washing machine, laundry to which mechanical power is transferred is separated from the drum, and collides with the rotating pulsator to again receive mechanical power so as to be pushed upward. At this time, the laundry moves while pulling the neighboring laundry. Accordingly, effects (which may be obtained by drum type washing machines) of beating washing and rubbing by the movement of the laundry may be obtained although the typical effect of kneading washing is not obtained. Also, since the laundry is mixed, stains may be reduced.

According to the washing machine of the present disclosure, it may be possible to improve washing power and to reduce a washing time.

DETAILED DESCRIPTION

Hereinafter, embodiments of the present disclosure will be described in detail with reference to the accompanying drawings. However, the following description is exemplary, and does not limit the present disclosure, applications thereof, or purposes of use thereof.

<Basic Configuration of Washing Machine>

Figure 1:
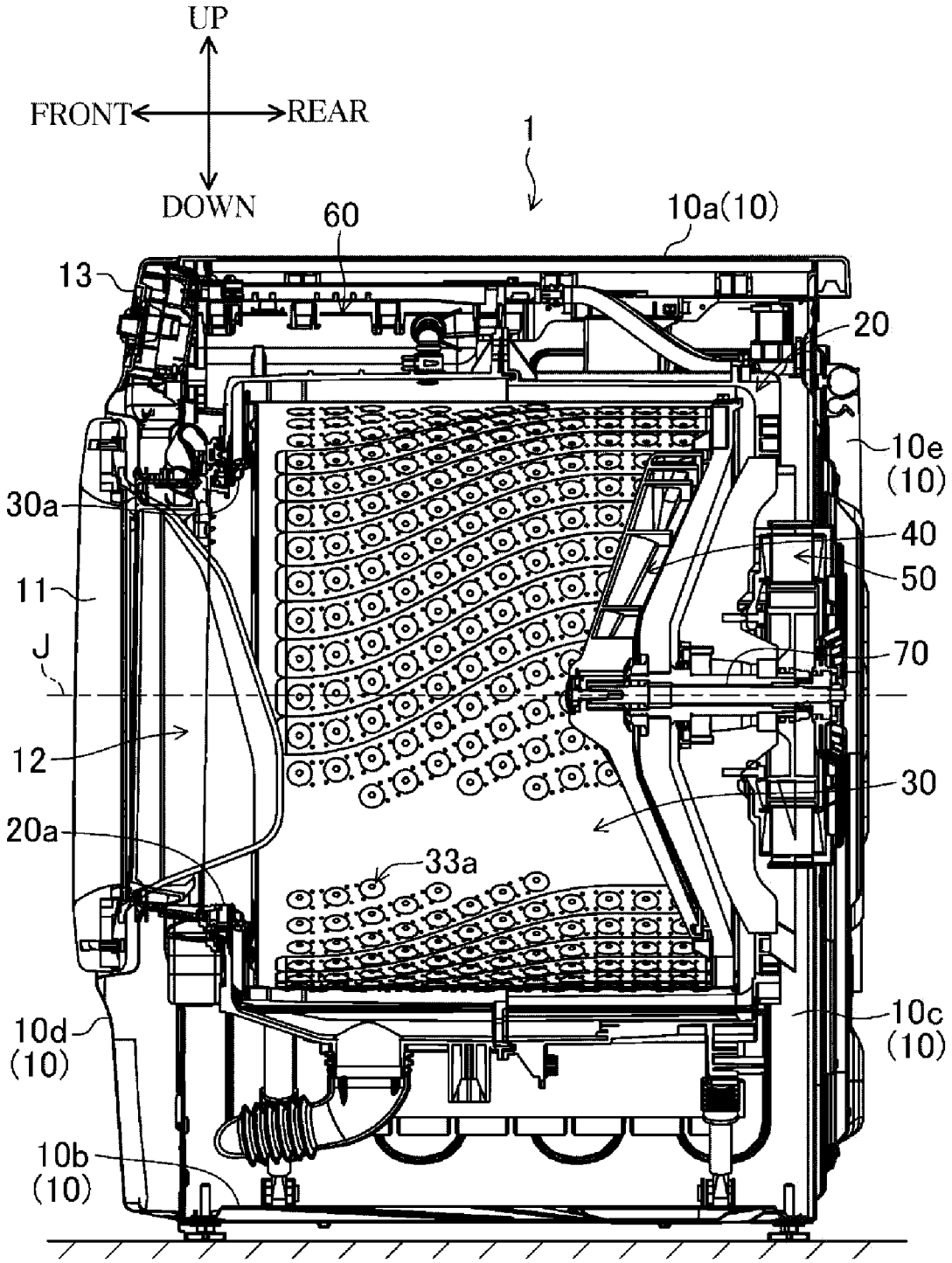
FIG. 1 is a schematic cross-sectional view of a washing machine according to an embodiment.
Figure 2:
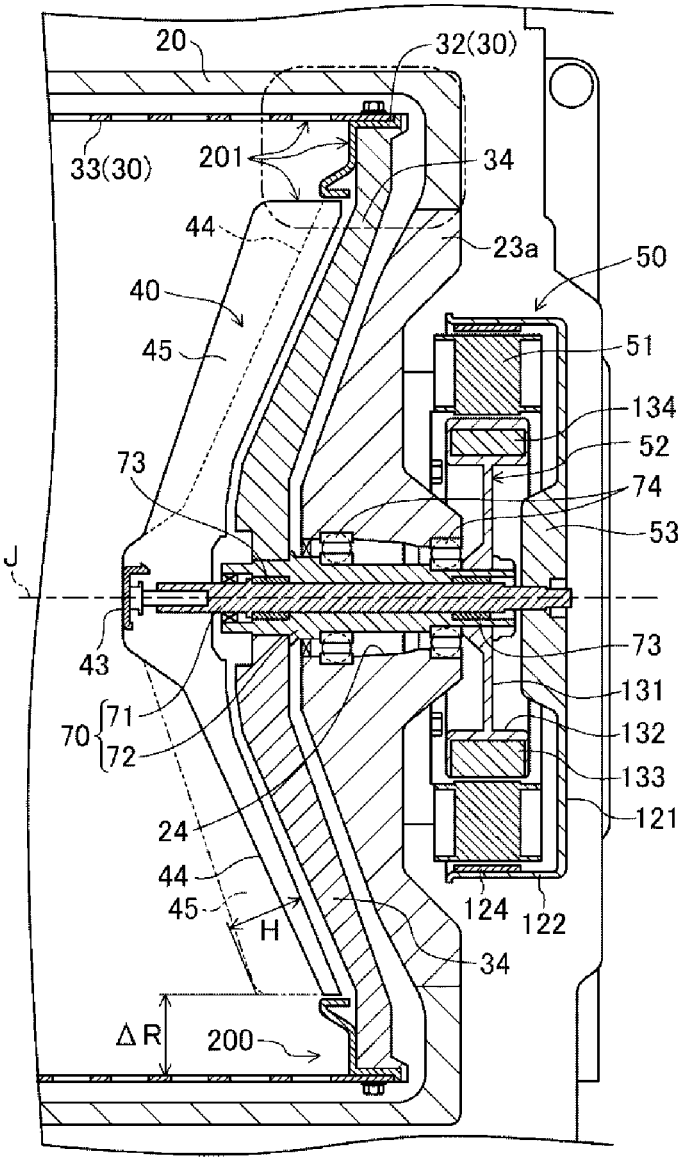
FIG. 2 is an enlarged view of main components of FIG. 1.

In FIGS. 1 and 2, a washing machine 1 (drum type washing machine) according to an embodiment is shown. The washing machine 1 may include a housing 10, a tub 20, a drum 30, a pulsator 40, a motor 50 (driving device), and a controller 60 (a control device), and washing operation, rinsing operation, and dehydrating operation may be automatically performed according to a set program (full-automatic type). Particularly, the washing machine 1 may include the motor 50 having a compact size and configured to enable the washing machine 1 to show appropriate performance according to each operation. The motor 50 will be described in detail, later.

The housing 10 may be in the shape of a rectangular box having a top side 10*a*, a bottom side 10*b*, a pair of left and right sides 10*c*, a front side 10*d*, and a rear side 10*e*. In a center of the front side 10*d*, an opening 12 may be formed in a circular shape and opened or closed by a door 11. Laundry may be put into or taken out of the washing machine 1 through the opening 12. In a upper portion of the front side 10*d*, a control panel 13 on which a switch, etc. are located may be installed, and the controller 60 may be installed behind the control panel 13.

The tub 20 may be a cylindrical container having a bottom, and in one side of the tub 20, an opening 20*a* having a diameter that is smaller than the inner diameter of the tub 20 may be formed. The tub 20 may be located in the inside of the housing 10 in the state that the opening 20*a* is toward the opening 12 such that the center line of the opening 20*a* extends nearly horizontally in a front-back direction. Upon washing or rinsing operation, washing water or rinsing water may be collected in the lower portion of the tub 20.

The drum 30 may be a cylindrical container having an opening 30*a* in one side and a bottom in the opposite side, and may be accommodated in the inside of the tub 20 in the state in which the opening 30*a* is toward the front direction. The opening 30*a* may have an inner diameter that is smaller than that of a moving body (wrapper 33 which will be described later) of the drum 30. The drum 30 may be rotatable on a rotation axis J extending in the front-back direction, and when laundry is accommodated in the drum 30, washing operation, rinsing operation, and dehydrating operation may be performed.

Figure 4:
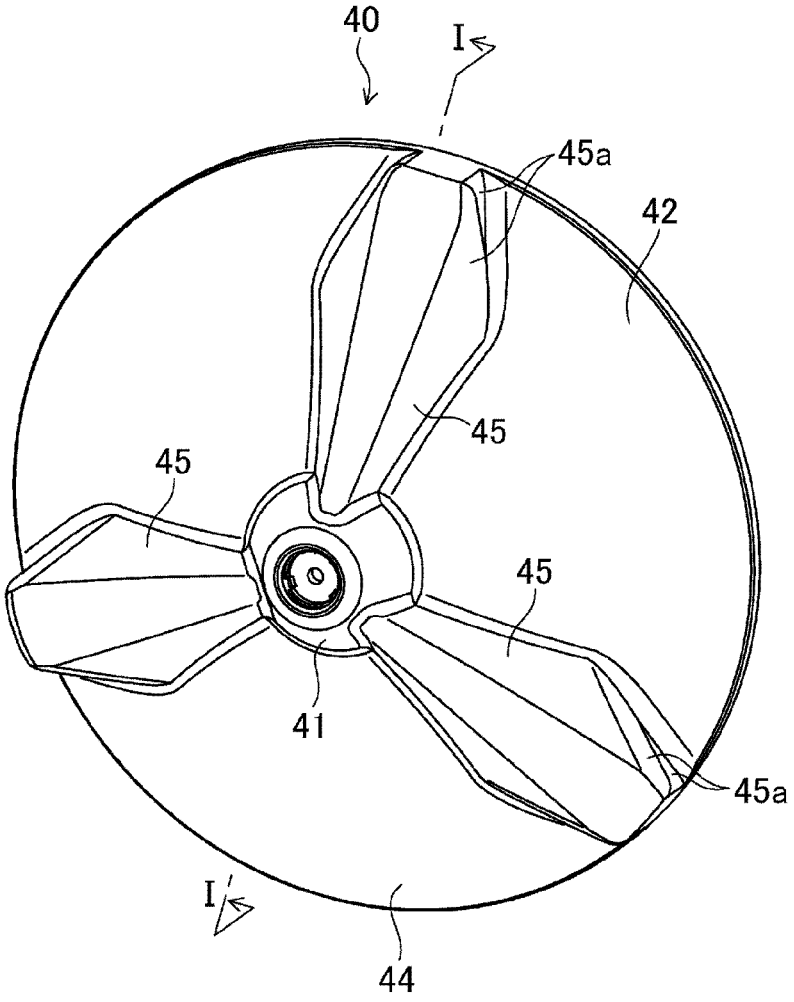
FIG. 4 is a schematic perspective view of a pulsator.
Figure 5:
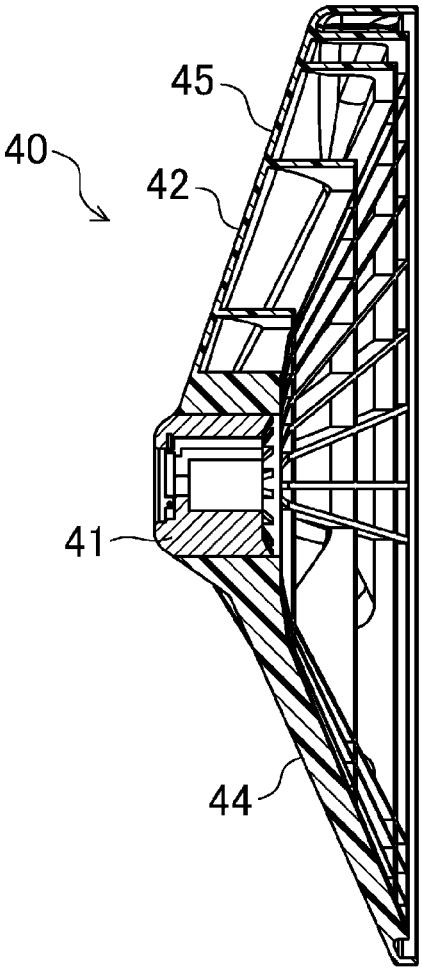
FIG. 5 is a cross-sectional view taken along arrow line I-I of FIG. 4.
Figure 6:
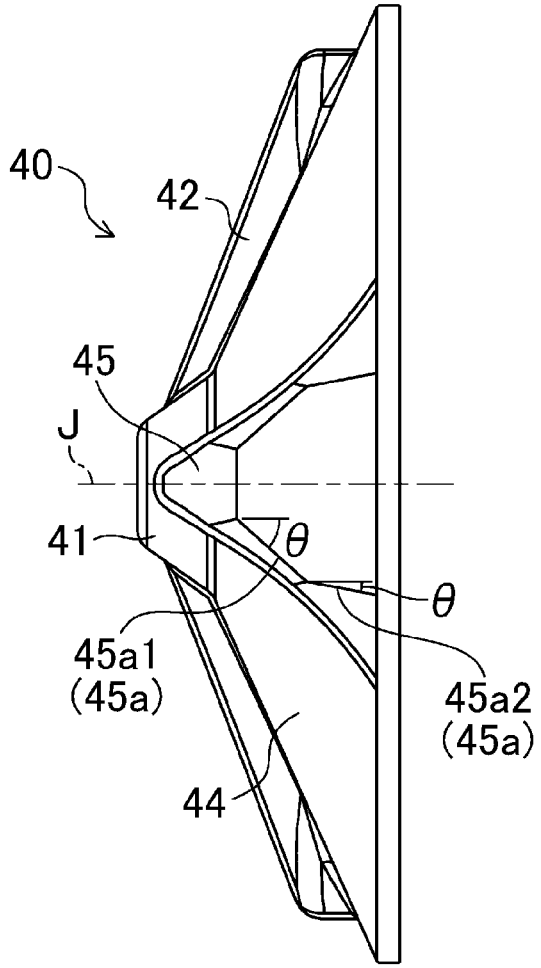
FIG. 6 is a schematic side view of a pulsator.

As shown detailedly in FIGS. 4 to 6, the pulsator 40 may be a disc-shaped member having a front surface formed in the shape of a low cone. The pulsator 40 may have a protrusion 45 extending in a radial direction from the front surface, and may be positioned on the bottom of the drum 30. The pulsator 40 may be rotatable with respect to the rotation axis J, independently from the drum 30.

As shown detailedly in FIG. 2, a double shaft 70 consisting of an inner shaft 71 and an outer shaft 72 may penetrate the bottom of the tub 20 along the rotation axis J. The outer shaft 72 may be a cylindrical shaft having a shorter shaft length than the inner shaft 71. The inner shaft 71 may be rotatably axial-supported in the inside of the outer shaft 72 through an inner bearing 73. The outer shaft 72 may be rotatably axial-supported in a bearing housing 23*a* of the tub 20 through outer bearings 74.

The drum 30 may be connected to and supported on a top of the outer shaft 72, and the pulsator 40 may be connected to and supported on a top of the inner shaft 71. The outer shaft 72 and the inner shaft 71 may be connected to the motor 50 positioned behind the tub 20.

The motor 50 may drive the outer shaft 72 and the inner shaft 71, independently. The controller 60 may be configured with hardware, such as Central Processing Unit (CPU) or memory, and software such as control programs, control overall operations of the washing machine 1, and automatically perform washing operation, rinsing operation, and dehydrating operation according to an instructure received from the control panel 13.

<Detailed Configuration of Washing Machine>

Figure 3A:
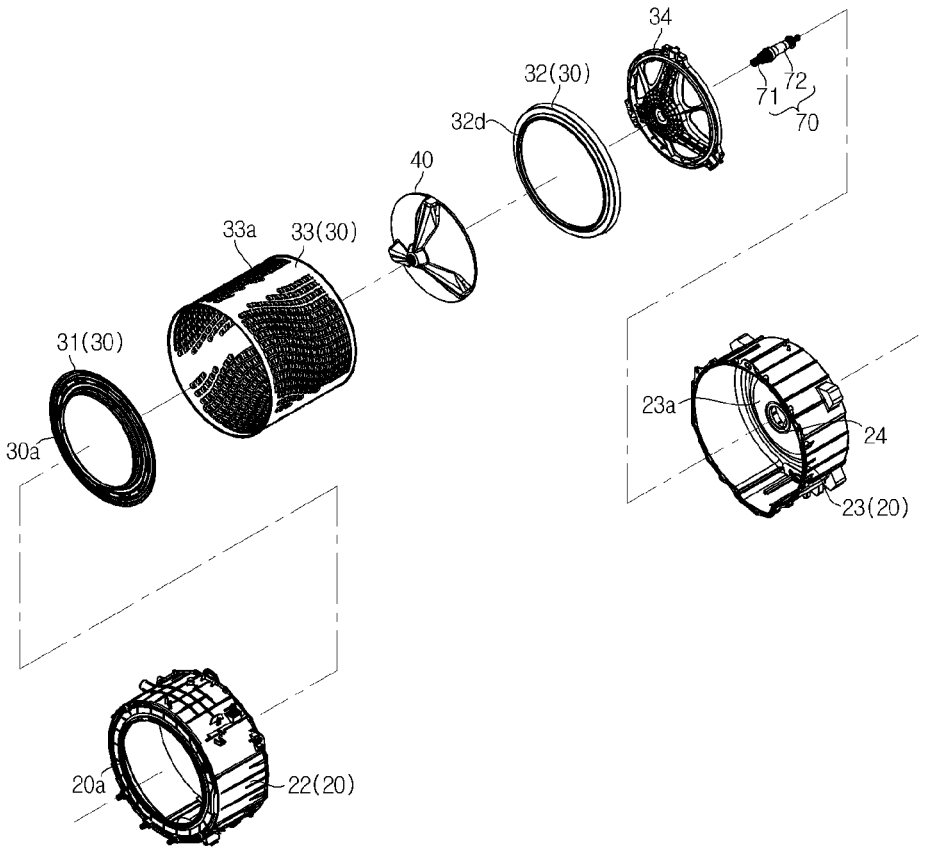
FIG. 3A is an exploded perspective view of main components of a washing machine.

As shown in FIG. 3A, the drum 30 may be configured with a drum front 31 formed in the shape of a circular ring and having the opening 30*a*, a drum back 32 formed in the shape of a circular ring and being opposite to the drum front 31 in the front-back direction, and the cylindrical wrapper 33 connecting the drum front 31 to the drum back 32.

In the wrapper 33, a plurality of through holes 33*a* may be formed, and washing water collected in the tub 20 may enter the inside of the drum 30 through the through holes 33*a*. Each through hole 33*a* may be in the shape of a burring, and protrude in a spherical shape in the inner wall of the drum 30. The through holes 33*a* may also be formed in the drum front 31, the drum back 32 or the pulsator 40, as well as the wrapper 33.

The drum front 31 and the wrapper 33 may be integrated into one body or separatably connected to each other by pressed-binding, screw-fixing, etc. The wrapper 33 and the drum back 32 may also be integrated into one body or separatably connected to each other by pressed-binding, screw-fixing, etc.

The drum 30 may be fixed on the outer shaft 72 through a flange shaft 34 (also, referred to as a flange member) formed in a disc shape and attached on the bottom of the drum 30. The flange shaft 34 and the outer shaft 72 may be integrated into one body in consideration of working efficiency upon assembly by pressing the outer shaft 72 into the flange shaft 34 or by insert-molding the outer shaft 72 into the flange shaft 34.

In the case of integrating the flange shaft 34 with the drum 30 by assembling the flange shaft 34 into the drum 30, for easiness of assembly, it may be preferable to fix the flange shaft 34 on an outer circumference of the wrapper 33 through screws, etc. When the drum 30 is configured with a plurality of members, it may be preferable to insert a bent part of the dorm back 32 between the wrapper 33 and the flange shaft 34 to couple them together. The drum back 32 may be first fixed at and assembled with the flange shaft 34, and then the wrapper 33 may be coupled with the flange shaft 34.

Figure 3B:
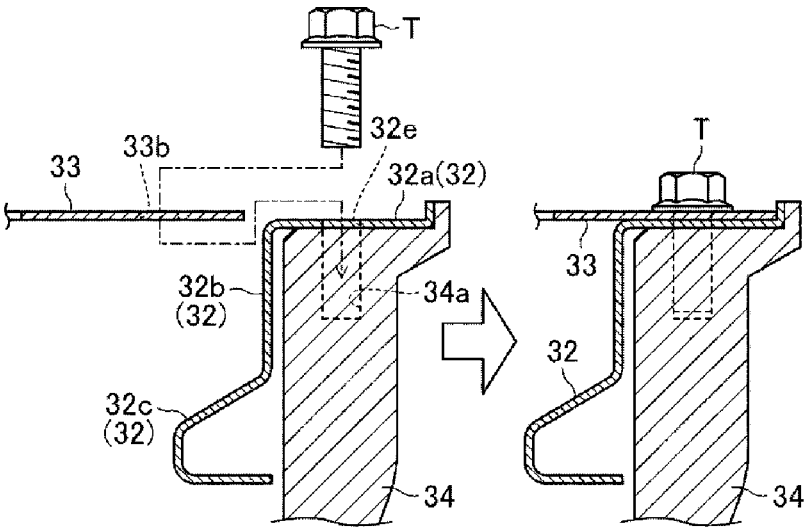
FIG. 3B is a view for describing an assembly of a part surrounded by two-dot chain line of FIG. 2.

In the washing machine 1, the drum 30 and the flange shaft 34 may be assembled in this way. Details about the assembly are shown in FIG. 3B. The wrapper 33 or the drum back 32 may be formed generally by bending or pressing a metal plate. Therefore, by installing the circular drum front 31 and the drum back 32, respectively, at inner edges of front and rear ends of the wrapper 33 in the shape of a cylinder and integrating the drum front 31 and the drum back 32 into the wrapper 33, the structural strength and stiffness of the drum 30 may be secured.

Also, the drum back 32 may include an outer coupling portion 32*a* formed in the shape of a cylinder, and a ring-shaped flange portion 32*b* protruding inward from a front end of the outer coupling portion 32*a*. In a center of the ring-shaped flange portion 32*b*, an expansion portion 32*c* may be formed which expands with a gentle slope toward the front direction, and a rear opening 32*d* may be formed in a circular shape by an inner end of the expansion portion 32*c*.

An external diameter of the outer coupling portion 32*a* may be substantially equal to an internal diameter of the wrapper 33, and the wrapper 33 may be fitted into the outer coupling portion 32*a*. An inner diameter of the outer coupling portion 32*a* may be substantially equal to an external diameter of an outer end of the flange shaft 34, and the outer coupling portion 32*a* may be fitted into the outer end of the flange shaft 34. An inner end surface (a cylindrical part) of the expansion portion 32*c* may be a little larger than an external diameter of the pulsator 40, and opposite to an outer circumference of the pulsator 40 with a small gap.

In a rear end of the wrapper 33, a plurality of outer through holes 33*b* may be formed at a plurality of locations. In the outer coupling portion 32*a*, a plurality of inner through holes 32*e* may be formed to respectively overlap the plurality of outer through holes 33*b*. Also, a plurality of coupling holes 34*a* may be formed to overlap the outer through holes 33*b* and the inner through holes 32*e*, at a plurality of locations of the outer end of the flange shaft 34.

When the wrapper 33, the drum back 32, and the flange shaft 34 are assembled, as shown in FIG. 3B, the drum back 32 may be first inserted into and fixed at the flange shaft 34 so that the outer coupling portion 32*a* is fitted into the outer circumferential end. Thereafter, the rear end of the wrapper 33 may be inserted into the outer coupling portion 32*a*, and a plurality of coupling members T may be respectively inserted into the outer through holes 33*b*, the inner through holes 32*e*, and the coupling holes 34*a* overlapping each other, outermost first in the diameter direction. Thereby, the wrapper 33, the drum back 32, and the flange shaft 34 may be coupled with each other and integrated into one body.

As such, since the flange shaft 34 having excellent strength and stiffness has a large diameter that is substantially equal to that of the wrapper 33 (that is, the drum 30) and is coupled with the wrapper 33 together with the drum back 32 outermost first in the diameter direction to be integrated into one body, the strength and stiffness of the drum 30 may be improved to be stably supported although it rotates and shakes in the horizontal direction.

In typical washing machines, regardless of whether they are top loading types or drum types, the diameter of the flange shaft is sufficiently smaller than that of the drum, and the drum is coupled with the flange shaft in an extension direction of the rotation shaft through the drum back.

When the drum 30 is configured with a single member, it may be possible to couple and fix the drum back 32 and the flange shaft 34 through screws, etc. from the front direction of the wrapper 33, not from the outer circumference of the wrapper 33.

When the flange shaft 34 and the outer shaft 72 are not integrated into one body by insert-molding, press-fitting, etc., a serration or a rotation preventing structure formed by concave-convex fitting by a key and a key groove or the like may be installed at a connection portion of the flange shaft 34 and the outer shaft 72 to thereby limit rotations in a rotation direction. After the flange shaft 34 is fitted into the outer shaft 72 in such a way to be easily fixed and unfixed so as not to rotate, the flange shaft 34 may be coupled with the outer shaft 72 from an axial direction through a nut or bolt to thereby limit movements in the axial direction.

The inner bearing 73 may be a ball bearing or a sliding bearing. The inner bearing 73 may be pressed in and fixed at any one of the outer shaft 72 and the inner shaft 71, and the other one of the outer shaft 72 and the inner shaft 71 may be loosely fitted into the inner bearing 73. One ends of the outer shaft 72 and the inner shaft 73 may have a step portion of a size that is different from the external diameter of the main shaft by forming a flange or installing a snap ring, and the step portion may contact the inner bearing 73 and be fixed. Between the outer shaft 72 or the inner shaft 71 and the inner bearing 73, a washer, etc. may be inserted.

The other ends of the outer shaft 72 and the inner shaft 71 may be fixed by a snap ring, etc. to prevent misalignment or escaping upon transferring or assembling. Also, a washer, etc. may be installed at the other ends of the outer shaft 72 and the inner shaft 71. At one end of the double shaft 70 toward the tub 20, a seal member may be installed to prevent washing water from entering the inside of the double shaft 70 or from leaking out of the tub 20 through the double shaft 70 (waterproof structure).

The tub 20 may be configured with two or more components. The tub 20 may be configured with upper and lower portions or left and right portions, however, it is most effective to configure the tub 20 with two portions of front and rear portions. Therefore, in the washing machine 1, the tub 20 may be configured with two portions of a tap front 22 and a tap back 23. A seal structure for preventing water from leaking out may need to be installed at a connection portion of the tub 20.

At a front end of the tap front 22, an opening 20*a* may be formed. At a rear end of the tap back 23, a bearing housing 23*a* may be installed. The tap back 23 and the bearing housing 23*a* may be made of different materials. The tap back 23 and the bearing housing 23*a* may be manufactured as separate members, and then the bearing housing 23*a* may be fixed at the tap back 23 through a bolt or the like. In this case, a seal structure may need to be installed at the connection portion between the bearing housing 23*a* and the tap back 23.

Therefore, the bearing housing 23*a* and the tap back 23 may be preferably integrated into one body by insert-molding. The tap back 23 and the bearing housing 23*a* may be made of the same material, and then integrated into one body. However, in the case of an aluminum diecast, this method is not realistic in view of weight, size, and cost. Also, the bearing housing 23*a* may be formed by combining metal plates, such as steel plates or stainless plates, however, in the washing machine 1, the bearing housing 23*a* (aluminum diecast material) and the tap back 23 (resin material) may be integrated into one body by insert-molding.

The bearing housing 23*a* may have a shaft support 24 for supporting the outer shaft 72 through the outer bearings 74. The bearing housing 23*a* may also be configured with two or more components. The outer shaft 72 may be axially supported through two or more outer bearings 74 spaced in an axial direction from the bearing housing 23*a*. The outer bearings 74 may be pressed in any one of the outer shaft 72 and the bearing housing 23*a*, and the other one of the outer shaft 72 and the bearing housing 23*a* may be loosely fitted into the outer bearings 74.

Since a front portion of the tap back 23 is open, the outer shaft 72 may be inserted into the shaft support 24 formed in a cylindrical shape in the center of the bearing housing 23*a* from the front portion of the tap back 23, although the outer shaft 72 is integrated into the flange shaft 34. When the outer shaft 72 is a separate body from the flange shaft 34, the outer shaft 72 may be inserted into the shaft support 24 from the rear portion of the tap back 23.

When the outer shaft 72 is loosely fitted into the outer bearings 74, the outer shaft 72 may have the same external diameter through the entire length, or an external diameter of a portion of the outer shaft 72 at which the outer shaft 72 starts being inserted into the outer bearings 74 may need to be smaller than that of a portion of the outer shaft 72 at which the outer shaft 72 is completely inserted into the outer bearings 74. Meanwhile, when the outer bearings 74 pressed in the outer shaft 72 are loosely fitted into the shaft support 24, the shaft support 24 may have an internal diameter that is at least equal to or greater than those of the outer bearings 74, and the inner diameter of the portion of the outer shaft 72 at which the outer shaft 72 starts being inserted into the outer bearings 74 may need to be larger than that of the portion of the outer shaft 72 at which the outer shaft 72 is completely inserted into the outer bearings 74. When the bearing housing 23*a* is configured with two or more components, the limitation is not applied. Also, the front portions of the outer bearings 74 may be larger than the rear portions of the outer bearings 74 so that the outer bearings 74 are inserted from the front portion of the tap back 23 to axially support the tap back 23 stably.

As shown in FIG. 4, the pulsator 40 may include a boss portion 41 positioned in the center, and a disc portion 42 positioned around the boss portion 41. As shown in FIG. 2, the boss portion 41 may be fixed at the protruding end of the inner shaft 71. Between the boss portion 41 and the inner shaft 71, a serration or a rotation preventing structure formed by concave-convex fitting by a key, etc. may be provided to restrict a rotation in the rotation direction.

In view of strength, the boss portion 41 and the disc portion 42 may be manufactured with, preferably, two or more components made of different materials. When the boss portion 41 and the disc portion 42 are made of the same material, strength may deteriorate. That is, a metal of high strength, such as aluminum or stainless steel, may be not adopted, since it increases the weight of the pulsator 40 to increase the force of inertia, resulting in an increase of energy loss. When resin, etc. is used, durability may deteriorate since the resin wears down or is broken easily.

Accordingly, it may be efficient that the boss portion 41 is made of a material of high strength such as stainless steel with a small size, and the disc portion 42 is made of resin, etc. of light weight. The boss portion 41 may be fixed at the disc portion 42 by pressing-fitting, insert-molding, etc. The front surface of the disc plate 42 may be resin, however, the front surface of the disc plate 42 may be covered with a thin film of stainless steel, etc. for appearance's sake or for preventing being cut, etc.

Also, the disc portion 42 may be formed with a stainless steel sheet although the stainless steel sheet is expensive. When the disc portion 42 is formed with resin, etc., the resin may need to be formed with a thickness of about 3 mm to about 5 mm to secure a predetermined level of strength. However, when the disc portion 42 is formed with a stainless steel sheet, the disc portion 42 may be formed with a thickness of about 1 mm. Thereby, it may be possible to further increase the capacity of the washing machine 1.

The boss portion 41 may be inserted into the protruding end of the inner shaft 71 by concave-convex fitting in such a way to be easily fixed/unfixed in/from the protruding end of the inner shaft 71, and also, the boss portion 41 may be coupled with the protruding end of the inner shaft 71 by a bolt or a nut to be restricted from escaping from the protruding end of the inner shaft 71. To prevent laundry from being damaged by the coupling portion, a protective cap (protective member) 43 may be provided on a top of the boss portion 41. A labyrinth structure surrounding the edge of the pulsator 40 with a small gap may be used in a gap between the pulsator 40 and the drum 30 to prevent laundry from being stuck into the gap. Generally, the labyrinth structure may be formed with the drum back 32 and the pulsator 40. Accordingly, an external diameter of the pulsator 40 may be smaller than 100% of the internal diameter of the drum 30 and larger than 60% of the internal diameter of the drum 30.

When the external diameter of the pulsator 40 is equal to or greater than 60% of the internal diameter of the drum 30, the function of the pulsator 40, such as stirring, may be properly performed in the inside of the drum 30.

Particularly, the external diameter of the pulsator 40 may be preferably smaller than the internal diameter of the opening 30*a*. In this case, since the pulsator 40 is put into the inside of the drum 30 through the opening 30*a*, the pulsator 40 may be assembled in the drum 30 after the drum 30 is assembled, thereby simplifying a manufacturing process. Also, when an error is generated in the pulsator 40 with long-term use, a user may easily replace components with low cost.

Meanwhile, when the external diameter of the pulsator 40 is larger than the diameter of the opening 30*a*, the pulsator 40 may be put into the drum 30 from behind. In this case, the pulsator 40 may need to be inserted in the inside of the drum 30 before a process of integrating the wrapper 33 and the drum back 32 into one body by pressed-binding, welding, etc. However, in this case, the manufacturing process may become complicated, and therefore, it is not realistic.

Accordingly, the pulsator 40 may be fixed at the inner shaft 71 through flange shaft 34 before the wrapper 33 and the drum back 32 are integrated into one body, or the wrapper 33 and the drum back 32 may be coupled through screw-fixing, etc. in such a way to be separable from each other.

Meanwhile, by configuring the labyrinth structure with three or more components including the drum back 32, the pulsator 40, and the flange shaft 34, the pulsator 40 may be assembled after the drum back 32 and the wrapper 33 are integrated into one body. That is, the drum back 32 may configure a wall covering an outer side of the pulsator 40, and the flange shaft 34 or another component may configure a wall covering the other surface and inner surface of the pulsator 40.

However, to prevent the number of components from increasing, the wall covering the other surface and inner surface of the pulsator 40 may be configured preferably with the flange shaft 34. The outer wall of the pulsator 40 may be configured with the flange shaft 34, etc., instead of the drum back 32. However, in this case, there is probability that a gap is made around the inner surface of the drum 30 which laundry may contact, and the laundry may be damaged by the gap. Therefore, the outer wall of the pulsator 40 may be configured preferably with the drum back 32.

Figure 3C:
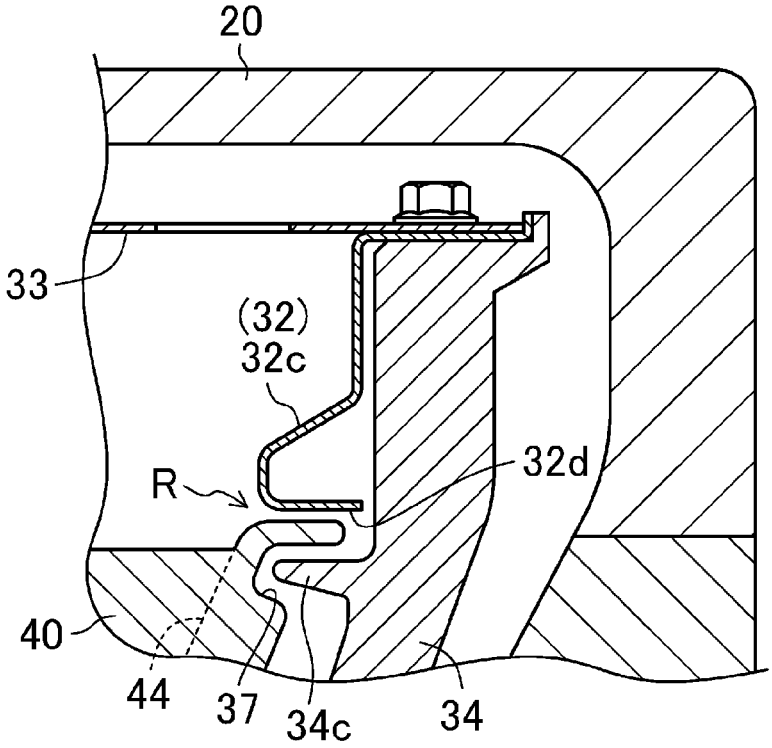
FIG. 3C is a partial cross-sectional view showing a preferable example of a washing machine.

In the washing machine 1, the labyrinth structure may be configured in this way. In FIG. 3C, an example of the labyrinth structure is shown in detail.

At a part of the drum 30 configuring the rear opening 32*d*, the expansion portion 32*c* may smoothly connect to the circumferential portion of the pulsator 40 without making any great step with the circumferential portion (an edge portion of an inclined portion 44 which will be described later) of the pulsator 40. In other words, a front end of the outer circumference of the inclined portion 44 may be substantially at the same position as a front end of the expansion portion 32, in the extending direction of the rotation axis J.

Also, a ring-shaped rib 34*c* may protrude in the shape of a concentric circle along the outer circumference of the front surface of the flange shaft 34. In the other surface of the circumferential portion of the pulsator 40, a ring-shaped concave portion 37 may be formed in the shape of a concentric circle with substantially the same diameter as the ring-shaped rib 34*c*. By attaching the pulsator 40 to the double shaft 70 coupled with the flange shaft 34, the ring-shaped rib 34*c* may be accommodated in the ring-shaped concave portion 37 without contacting the ring-shaped concave portion 37.

Accordingly, the wall covering the outer side of the pulsator 40 may be configured by an inner end surface of the expansion portion 32*c* which is the inner circumferential portion of the drum back 32, the wall covering the other surface and inner surface of the pulsator 40 may be configured by the ring-shaped rib 34*c* and the front surface of the flange shaft 34, and the pulsator 40, the drum back 32, and the flange shaft 34 may be located close to each other with small gaps (labyrinth structure R) of complicated shapes.

By installing the labyrinth structure R, it may be possible to prevent laundry from being stuck between the pulsator 40 and the drum 30 or foreign materials from entering between the pulsator 40 and the flange shaft 34, even when the external diameter of the flange shaft 34 is larger than the external diameter of the pulsator 40.

<Motor 50>

The inner shaft 71 and the outer shaft 72 may be connected to the motor 50 which is a driving device. The motor 50 may be any one of the following types or configured by combining the types. The motor 50 of the washing machine 1 according to the current embodiment may be Type 1.

(Type 1)

In the motor 50 of Type 1, an inner rotor 52 and an outer rotor 53 may be respectively disposed in the inside and outside of a stator 51 (dual motor). The inner rotor 52 may be connected to the outer shaft 72, and the outer rotor 53 may be connected to the inner shaft 71. The two rotors 52 and 53 may be driven and controlled by a single inverter. The motor 50 will be described in more detail, later.

(Type 2)

Type 2 may be a dual motor, like type 1, wherein the two rotors 52 and 53 may be driven and controlled by two inverters. In the case of the motor, since the rotors 52 and 53 are driven and controlled independently by the two inverters, a ratio of rpms may be adjusted, and the rpms of the rotors 52 and 53 may be freely controlled.

(Type 3)

Type 3 is a motor having a two-layered double stator structure in which two stators, not one stator, are disposed in inside and outside relations, wherein an inner rotor and an outer rotor are respectively disposed in the inside and outside of the double stator structure. The motor may be configured by arranging the two motors which are functionally independent from each other in parallel around the rotation axis J. In the case of the motor, the two rotors may be driven and controlled independently by two inverters.

(Type 4)

Type 4 may be a motor configured by arranging two motors in the extending direction of the rotation axis J and then integrating them into one body. A rotor of a front motor which is close to the tap back 23 may be connected to the outer shaft 72, and a rotor of a rear motor may be connected to the inner shaft 71. The motors may be driven and controlled independently.

(Type 5)

Two typical motors may be used. However, unlike the direct-drive type motor described above, the drum 30 and the pulsator 40 may be respectively rotated by the respective motors through a power transfer mechanism including a shaft, a pulley, and an endless belt.

(Type 6)

Like Type 5, two typical motors (first motor and second motor) may used. However, the second motor may be an inner rotor type motor of a direct drive type having a rotor rotating with respect to the rotation axis J in the inside of a stator. On the outer side of the stator of the second motor, the pulley rotating with respect to the rotation axis J may be mounted, and the endless belt may be tightly mounted on the pulley (power transfer mechanism). The first motor may be connected to the pulley through the power transfer mechanism. The pulsator 40 may be driven by the first motor through the power transfer mechanism, and the drum may be driven by the second motor.

When the motor is installed in the tap back 23 or the bearing housing 23*a*, the motor may be preferably fixed directly in the tap back 23 or the bearing housing. However, the motor may be fixed indirectly in the tap back 23 or the bearing housing through a bracket, etc. To prevent vibrations caused by the motor from being transferred to the tap back 23, etc., the motor may be fixed in the tap back 23 or the bearing housing through an elastic bush, etc., such as rubber or resin. The motor may be fixed using a bolt or a nut. A washer for widening an axial force, a spring washer for preventing loosening, a wave washer, etc. may be inserted into the fastenings (member).

<Double Shaft 70>

The double shaft 70 may have an inner shaft 71 and an outer shaft 72, and may be installed in the cylindrical shaft support 24 installed in the center of the bearing housing 23*a* of the tub 20, wherein the axial center of the double shaft 70 may be identical to the rotation axis J.

The inner shaft 71 may be a shaft member formed in the shape of a spindling cylinder, and the outer shaft 72 may be a shaft member formed in the shape of a spindling cylinder that is shorter than the inner shaft 71 and has a greater internal diameter than the external diameter of the inner shaft 71. In the inside of the outer shaft 72, a pair of inner bearings 73 which are spaced vertically may be installed. The inner bearings 73 may be ball bearings or sliding bearings. The inner shaft 71 may be inserted into the outer shaft 72, and rotatably supported by the inner bearings 73.

The inner bearings 73 may be pressed in and fixed on any one of the outer shaft 72 and the inner shaft 71, and the other one of the outer shaft 72 and the inner shaft 71 may be loosely fitted into the inner bearing 73.

The front end of the inner shaft 71 may protrude from the front end of the outer shaft 72, and the rear end of the inner shaft 71 may protrude from the rear end of the outer shaft 72.

<Pulsator 40>

As shown in FIGS. 4, 5, and 6, on the front surface of the pulsator 40, the gently inclined portion 44 gently inclined downward toward the circumferential portion of the pulsator 40 from the boss portion 41, and a plurality of protrusion 45 may be formed. The gently inclined portion 44 may configure a base portion spreading in a disc form over the front surface of the pulsator 40, and the individual protrusions 45 may protrude from a surface of the base portion. Preferably, the gently inclined portion 44 may be nearly flat to reduce resistance when rotating. The individual protrusions 45 may extend in a radial direction from the boss portion 41, and be arranged radially at equidistant intervals in the circumferential direction. If the protrusions 45 are arranged unequally, a reaction force may become non-uniform, which causes abnormal vibrations.

Figure 9:
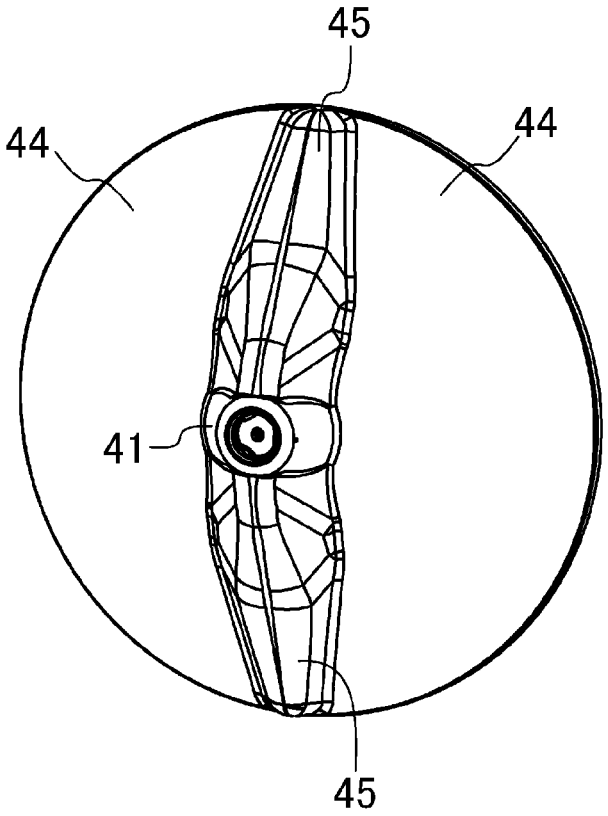
FIG. 9 shows another form of a pulsator.

The pulsator 40 may have three protrusions 45. The number of the protrusions 45 may be preferably 2 to 8, and more preferably, two or three protrusions 45 may be provided to obtain good results. A preferable example of a pulsator with two protrusions 45 is shown in FIG. 9. When two protrusions 45 are arranged, the protrusions 45 may extend in opposite directions toward the circumference of the pulsator 40 from the boss portion 41.

As the number of the protrusions 45 increases, laundry may have difficulties in entering between the protrusions 45 so that an effect of beating laundry with the protrusions 45 or taking off laundry from the protrusions 45 may be reduced and the mobility of laundry may also be reduced. Therefore, washing power may deteriorate, and consumption power may increase.

In areas between the protrusions 45 on the gently inclined portion 44, a plurality of protrusions that are smaller than the protrusions 45 may be formed at equidistant intervals. The small protrusions may provide an effect of rubbing laundry.

At the center parts of the protrusions 45 around the boss portion 41, no great effect may be obtained below the rated capacity (for example, 60% of the capacity of the drum 30) of laundry since the frequency of contact of the laundry to the center parts is low. Accordingly, a height of the center parts of the protrusions 45 with respect to the gently inclined portion 44 may be preferably low.

Meanwhile, the outer parts of the protrusions 45 may have greater influence on separating performance of laundry. Accordingly, the outer parts of the protrusions 45 may protrude, preferably, higher from the gently inclined portion 44 than the center parts of the protrusions 45.

However, as the protrusions 45 protrude higher from the gently inclined portion 44, torque required for rotating the pulsator 40 may increase accordingly. Also, when the drum 30 and the pulsator 40 rotate in opposite directions, a force of the protrusions 45 may be applied in a direction of canceling the rotation of the drum 30 through laundry, and therefore, torque required for rotating the drum 30 may increase. Accordingly, an excessive height of the outer parts of the protrusions 45 may be not preferable.

The shape of the protrusions 45 may also be important. The protrusions 45 may expand from the gently inclined portion 44, and extend in the form of a straight line radially from the boss portion 41. Each protrusion 45 may have a cross-section of an inverted "U" shape or an inverted "V" shape. At both sides in circumferential direction of the outer part of each protrusion 45, a plurality of inclined surfaces **45*a* may be formed, wherein the inclined surfaces 45*a*** may be nearly flat.

As shown in FIG. 6, when the inclined surfaces **45*a* are seen from the cross-section direction of the protrusions 45, laundry may have a head-on collision with the inclined surfaces 45*a* if an inclination angle θ of the inclined surfaces 45*a* with respect to the rotation axis J is small (if the inclined surfaces 45*a* are nearly in parallel to the rotation axis J). In this case, there is probability that the pulsator 40** is locked not to rotate or resists driving to rotate together with laundry. Also, there is probability that noise increases or abnormal vibrations are caused.

Accordingly, it may be preferable that the inclination angle θ of the inclined surfaces **45*a* is preferably 15° or more. As the inclination angle θ increases, rotation resistance of the pulsator 40** may also be reduced to reduce consumption power.

Meanwhile, as the inclination angle θ increases, laundry may have difficulties in being caught by the inclined surfaces **45*a* so that an effect of beating or taking off laundry may deteriorate. Therefore, the inclination angle θ of the inclined surfaces 45*a*** may be preferably 20° or less.

Accordingly, in consideration of balance, it may be preferable to form two inclined surfaces **45*a* having different inclination angles θ at both sides of the outer part of each protrusion 45. More specifically, a first inclination surface 45*a*1 having a relatively great inclination angle θ1 may be formed at the center part of the protrusion 45, and a second inclination surface 45*a*2 having a relatively small inclination angle θ2 may be formed at the outer part of the protrusion 45**.

As shown in FIG. 2, the outer circumferential edge of the pulsator 40 may face the inner circumferential surface of the drum 30 with a predetermined gap 200, and functional surfaces 201 contacting laundry and applying mechanical actions may be installed in the gap 200.

Thereby, when the drum 30 and the pulsator 40 rotate in opposite directions during washing, laundry may enter the gap 200 and contact the functional surfaces (more specifically, the inner circumferential surface of the drum 30 facing the gap 200, the bottom of the drum 30, and the outer parts of the protrusions 45) 201 located adjacent to each other and extending in three directions so that mechanical actions may be effectively provided to the laundry.

However, in the case in which the gap 200 is formed, there is probability that when a large amount of laundry is accommodated in the drum 30, the laundry may be stuck into the gap 200 according to the shape of the gap 200 so that the laundry may be damaged or overload may be caused. Therefore, in the washing machine 1, to prevent laundry from being stuck into the gap 200, a size in diameter direction of the gap 200 and the height of the protrusions 45 from the gently inclined portion 44 may be set to satisfy predetermined conditions.

More specifically, as shown in FIG. 2, when the size in diameter direction of the gap 200 is ΔR (unit: mm), and a maximum height of the outer edge (one closer to the outer circumference of the pulsator 40 among parts resulting from bisecting the diameter) of the protrusion 45 from the gently inclined portion 44 is H (unit: mm), a relation of $0.1 \leq H/\Delta R \leq 1.0$ may be satisfied.

If H/ΔR is smaller than 0.1, more specifically, if the height of the protruding ends of the protrusions 45 is smaller than half the width of the gap 200, the gap 200 may become thin excessively so that it may be difficult to effectively apply mechanical actions to laundry. Meanwhile, if H/ΔR is greater than 1.0, more specifically, if the height of the protruding ends of the protrusions 45 is greater than the width of the gap 200, the gap 200 may become deep excessively, and accordingly, there is high probability that laundry is caught by the gap 200.

Therefore, by forming the gap 200 such that the relation is satisfied, it may be possible to provide, even when a large amount of laundry is accommodated in the drum 30, the laundry with mechanical actions through the functional surfaces 201, while preventing the laundry from being caught by the gap 200, and also it may be possible to effectively generate movements of laundry with a small amount of washing water.

(Modified Example of the Pulsator 40)

The pulsator 40 may be in the shape of a cone, however, the pulsator 40 may have a concave part. The pulsator 40 may be in the shape of a bowl whose top is concave, like a pulsator of a top loading type washing machine. However, in this case, it may be preferable that the circumferential part of the disc portion 42 is positioned behind the boss portion 41. When the circumferential part of the disc portion protrudes forward rather than the boss portion 41, laundry may cover the circumferential part, and weight of the laundry may be applied in addition to the force of inertia due to the large-sized pulsator 40 to the pulsator 40, thereby increasing the torque of the motor 50 driving the pulsator 40.

<Washing Method> in typical drum type washing machines, a washing method so-called "beating washing" in which the drum rotates to wash laundry through mechanical actions of raising the laundry and then dropping it is adopted. Since most of the mechanical power is decided by the diameter of the drum, it may be difficult to increase the mechanical power.

Increasing rpm to increase the mechanical power makes the laundry stuck on the drum not to fall, and accordingly, "beating washing" becomes impossible, resulting in a reduction of mechanical power. Therefore, a method of repeatedly reversing the rotation direction of the drum to increase mechanical power may be considered, but this method causes great energy loss although increasing a small amount of mechanical power.

In regard of this, the washing machine 1 may not adopt "beating washing", and rotate the drum 30 and the pulsator 40 in opposite directions, thereby combining mechanical power of the drum 30 with mechanical power of the pulsator 40 to effectively provide the combined mechanical power to laundry.

Figure 7:
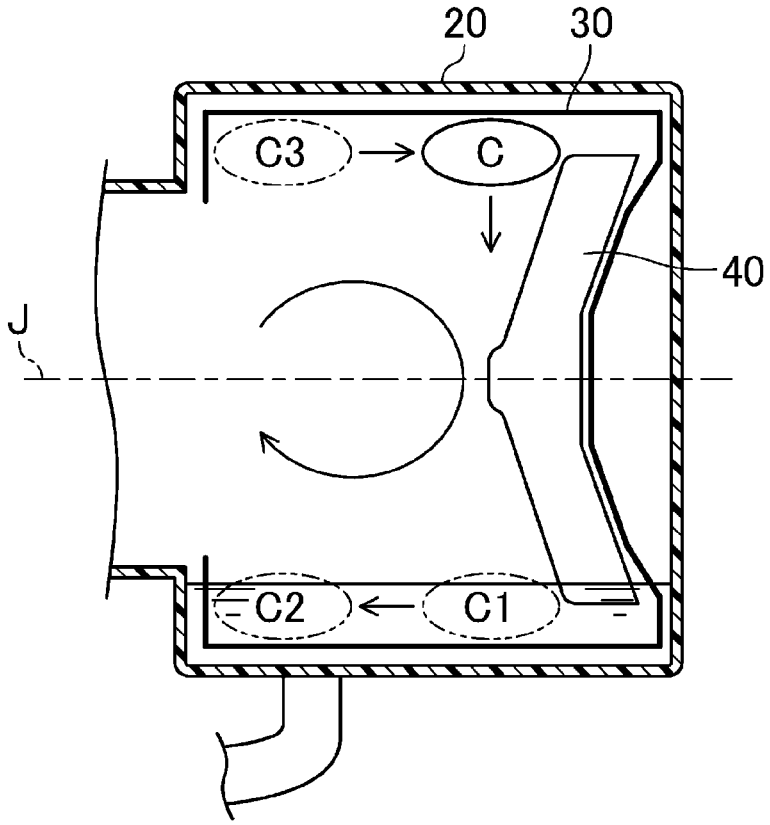
FIG. 7 is a view for describing a washing method.

More specifically, as shown in FIG. 7 during washing operation, the rpm of the drum 30 may be set to a value (for example, 50 rpm to 80 rpm) that is sufficiently greater than that of the typical drum type washing machines such that laundry C is stuck on the inner circumferential surface of the drum 30 by a centrifugal force. Also, the pulsator 40 may rotate in a direction that is opposite to a rotation direction of the drum 30, as indicated by a thin arrow in FIG. 8.

At this time, since the laundry C is stuck on the inner circumferential surface of the drum 30, the protrusions 45 of the pulsator 40 may collide with the laundry C to beat the laundry C, thereby transferring mechanical power to the laundry C. The laundry C may also be separated from the drum 30 due to an impact applied when it is beaten by the protrusions 45, or may be taken off from the drum 30 directly by the protrusions 45 although it is not beaten by the protrusions 45 (C1 in FIGS. 7 and 8).

The laundry C1 may collide with the rotating pulsator 40, and again receive mechanical power to be pushed forward (C2 in FIG. 7). The laundry C1 taken off from the drum 30 by the pulsator 30 may move forward while pulling the neighboring laundry. Thereby, the typical action of "beating washing" may be secured, and an effect of rubbing laundry by movements of the laundry may also be obtained.

Since the laundry C2 is pushed to the front portion of the drum 30, laundry located in the front portion of the drum 30 may move to the rear portion of the drum 30 along the inner circumferential surface of the drum 30 (from C3 to C in FIG. 7). Accordingly, in the inside of the drum 30, a flow of laundry of circulating in the front-back direction while rotating along the inner circumferential surface of the drum 30 may be formed.

As such, by transferring the mechanical power of the pulsator 40 to laundry and simultaneously causing the laundry to move complicatedly and three-dimensionally, stains may be reduced. Since mechanical power per unit time which is applied to laundry increases, it may be possible to improve washing power or to reduce a washing time.

The rpm of the drum 30 may be rpm (for example, 30 rpm) at which a centrifugal force may not be applied to laundry. In this case, an action of pushing laundry forward through the pulsator 40 and moving it may be obtained in addition to the typical action of "beating washing". However, when the rpm of the pulsator 40 is excessively low, the mechanical power of the pulsator 40 may be not transferred to laundry so as not to move the laundry sufficiently. Therefore, the pulsator 40 may require appropriate rpm, for example, 60 rpm or more.

Also, when the drum 30 rotates faster than the pulsator 40, the rotational moment of laundry may become greater than that of the pulsator 40, and accordingly, the pulsator 40 may be defeated by the force of the laundry to fail to obtain an appropriate flow. Therefore, by rotating the pulsator 40 faster than the drum 30, it may be possible to stably transfer the mechanical power of the pulsator 40 to laundry and to obtain a good three-dimensional flow.

Upon washing operation, the washing machine 1 may be driven in the following patterns.

(Pattern 1)

The drum 30 and the pulsator 40 may rotate at the same rpm in the same direction.

(Pattern 2)

The drum 30 and the pulsator 40 may rotate in the same direction, and the pulsator 40 may rotate at higher rpm than the drum 30.

(Pattern 3)

Power supply to the motor 50 for driving the pulsator 40 may be stopped, and while no power is supplied to the pulsator 40, the drum 30 may rotate.

(Pattern 4)

The pulsator 40 may be stopped by the control, and in this state, the drum 30 may rotate.

(Pattern 5)

Power supply to the motor 50 for driving the pulsator 40 may be stopped, and while no power is supplied to the pulsator 40, the drum 30 may rotate.

(Pattern 6)

The drum 30 may be stopped by the control, and in this state, the pulsator 40 may rotate.

(Pattern 7)

The drum 30 and the pulsator 40 may rotate in opposite directions, and the pulsator 40 may rotate at higher rpm than the drum 30.

(Pattern 8)

The drum 30 and the pulsator 40 may rotate at the same rpm in opposite directions.

During driving according to Pattern 1, the same operations as the typical drum type washing machines may be performed.

During driving according to Pattern 2, operation in which a convective effect by the pulsator 40 is applied to operation according to Pattern 1 may be performed. That is, in regard of laundry rotating in the drum 30, the pulsator 40 may rotate faster than the drum 30 so that an action of pushing the laundry or an action of pulling the laundry may be generated. The laundry pushed or pulled by the pulsator 40 may accelerate to climb over laundry existing in the front direction and to thus enter intermediate space in vertical direction of the drum 30. The operation may be successively repeated so that laundry existing in the rear space of the drum 30 may be pushed forward, and laundry existing in the front space of the drum 30 may move backward. As a result, the laundry may move in the inside of the drum 30, while circulating in the front-rear direction, and stains may be reduced.

During driving according to Pattern 3, since all mechanical power required for beating washing is obtained from the drum 30, the substantially same operations as the typical drum type washing machines may be performed. During the driving, since no power is supplied to the pulsator 40, consumption power may be reduced, while maintaining detergency.

During driving according to Pattern 4, the pulsator 40 may be maintained in a stopped state (during driving according to Pattern 3, the pulsator 40 may rotate by the force of inertia). Since the pulsator 40 is in the stopped state, the pulsator 40 may be in a relatively inverted state with respect to the rotating drum 30. Accordingly, an effect of detangling laundry or an effect of slightly beating laundry may be obtained.

Since driving according to Pattern 5 rotates the pulsator 40 in the state in which the drum 30 may rotate by the force of inertia, which is contrary to driving according to Pattern 3, a sufficient amount of water may be filled in the tub 20 to thus generate water streams, thereby performing "kneading washing", like typical top loading washing machines. For example, when laundry is delicate clothes, driving according to Pattern 5 may be performed to prevent the laundry from being damaged or deformed.

During driving according to Pattern 6, unlike the driving according to Pattern 5 in which the drum 30 may rotate by the force of inertia, the drum 30 may be maintained in a stopped state.

Driving according to Pattern 7 may perform the most effective operation for implementing the above-described washing mechanism. During driving according to Pattern 8, operation of the pulsator 40 may deteriorate rather than during the driving according to Pattern 7. Therefore, Pattern 8 may be suitable when mechanical power that is applied to laundry needs to be reduced.

In the typical drum type washing machines that perform "beating washing", the rpm of the drum 30 during washing operation may be generally set to a value that is smaller than 50 rpm to prevent laundry from being stuck on the drum 30. Therefore, washing water collected in the tub 20 may stay so that it may be difficult to continuously supply washing water to the inside of the drum 30 and circulate the washing water.

Therefore, a type of continuously supplying washing water collected in the tub 20 to the inside of the drum 30 and circulating the washing water by installing a pump, etc. has been developed. However, the type has a complicated structure, and cause an increase of running cost. Also, a type that performs, during washing, pumping-up operation of pumping up washing water to the inside of the drum 30 by rotating the drum 30, without using any pump, has been developed. However, during the pumping-up operation, it may be necessary to set the rpm of the drum 30 to a great value (for example, 60 rpm to 120 rpm), and during the pumping-up operation, laundry is stuck on the drum 30 so that beating washing may not be performed. Therefore, the pumping-up operation may be performed for a short time during washing, so that a sufficient effect may not be obtained.

Since the washing machine 1 sets the rpm of the drum 30 to a greater value than the typical drum type washing machines, the washing machine 1 may continue to supply washing water to the inside of the drum 30 and circulate the washing water, without having to install a pump, etc. That is, during washing operation, the washing machine 1 may rotate the drum 30 at 60 rpm or more. Thereby, washing water may spout from the gap between the tub 20 and the drum 30, and the washing water may enter the inside of the drum 30. Therefore, since a uniform amount of washing water is continuously supplied to laundry and circulated, while supplying sufficient mechanical power to the laundry and causing the laundry to move, high washing power may be secured, and running cost may be prevented from increasing.

Also, a type of continuously supplying foamed washing water to the inside of the drum 30 and circulating the washing water to improve a washing effect has been developed. The type includes a special device for foaming washing water.

The washing machine 1 may rotate the drum 30 at 60 rpm or more to stir washing water at the narrow gap between the tub 20 and the drum 30 to thereby form bubbles. The foamed washing water may be pumped up to be continuously supplied to the inside of the drum 30 and circulated, as described above. As such, the washing machine 1 may continuously supply foamed washing water and circulate it, without installing any special device.

Also, supplying and circulating of washing water or foaming of washing water may be performed by rotating the pulsator 40, instead of the drum 30. To increase the efficiency of supplying and circulating of washing water or the efficiency of foaming of washing water, convex-concave structures, stirring blades, etc. may be formed on the drum 30 or the pulsator 40.

In the typical drum type washing machines, a structure called a "lifter" protrudes from the inner circumferential surface of the drum 30. The lifter has a function of efficiently raising laundry when the drum 30 rotates and dropping the laundry from a high location, and is important in increasing mechanical power by beating washing.

However, the washing machine 1 may require no lifter to make laundry stuck on the inner circumferential surface of the drum 30 by a centrifugal force. Although a lift is installed, the height of the lifter may be law. In contrast, if there is a large lifter, there is probability that when laundry is caught between the lifter and the protrusions 45 of the pulsator 40, the laundry may be damaged. Therefore, the lifter may be preferably small.

Accordingly, by omitting or miniaturizing the lifter, cost of components may be reduced, and the capacity of the drum 30 may increase. Also, small protrusions, instead of the lifter, may be formed on the inner circumferential surface of the drum 30.

<Driving Control>

To derive optimal performance during washing operation of the washing machine 1, a proper driving pattern may be selected depending on situations.

For example, when the drum 30 and the pulsator 40 rotate in opposite directions, power consumption may increase if a large amount of laundry is accommodated in the drum 30, for example, if the amount of laundry is around the rated capacity. In this case, the rpms of the drum 30 and the pulsator 40 may be set to great values to suppress power consumption.

That is, since laundry is easily distributed non-uniformly in the inside of the drum 30 if the rpms are low, high torque may be needed, whereas when the rpms are high, laundry may be easily stuck on the inner circumferential surface of the drum 30 so that a non-uniform distribution of the laundry may be suppressed, and accordingly, high torque may be not needed. As the rpm of the pulsator 40 increases, laundry may be not easily caught by the protrusions 45 to reduce power consumption.

Meanwhile, if the rpm of the drum 30 is excessively high when the amount of laundry is small and sufficient space exists in the inside of the drum 30, the centrifugal force may increase so that the amount of laundry caught by the protrusions 45 may decrease. Accordingly, in this case, an optimal operation pattern, such as decreasing the rpm of the drum 30 or performing beating washing, may need to be selected.

Figure 10:
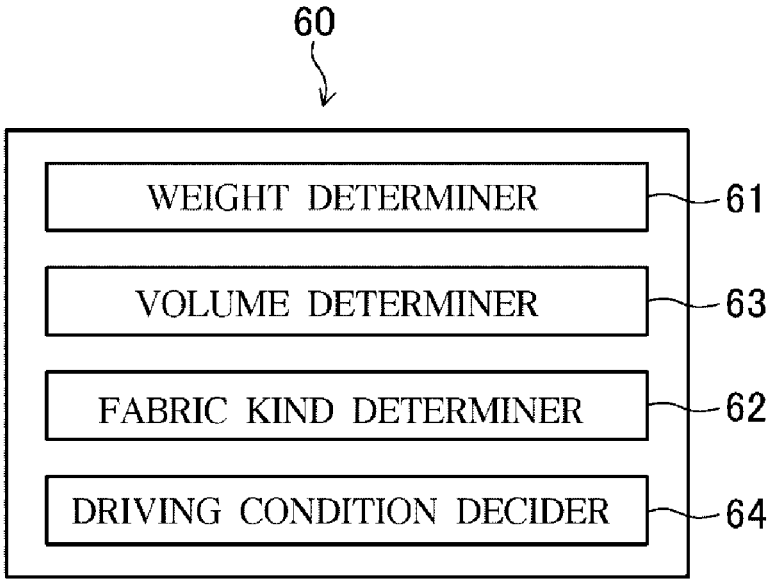
FIG. 10 is a block diagram of main functional portions of a controller.

To perform this, the weight, volume (the remaining capacity of the drum 30), kinds (kinds of fabric), etc. of laundry put in the drum 30 may need to be determined before washing operation is performed. Accordingly, the controller 60 of the washing machine 1 may include a weight determiner 61, a fabric kind determiner 62, a volume determiner 63, a driving condition decider 64, etc., as shown in FIG. 10.

The weight determiner 61 may determine weight of laundry put in the inside of the drum 30. For example, after laundry is put in the drum 30, the weight determiner 61 may rotate the drum 30 and the pulsator 40 in the same direction or in opposite directions to determine weight of the laundry. The rpms of the drum 30 and the pulsator 40 may be constant or change.

The weight determiner 63 may again rotate the drum 30 and the pulsator 40 in a direction that is opposite to the rotation direction of the drum 30 and the pulsator 40 when the weight of the laundry is determined. Thereby, the weight determiner 63 may calculate a ratio of the capacity of the laundry with respect to the capacity of the drum 30, based on a difference from the determined weight.

The fabric kind determiner 62 may put a predetermined amount of water in the inside of the tub 20, and cause the laundry to absorb the water for a predetermined time. The fabric kind determiner 62 may store absorption data according to kinds of fabric, and determine a kind of the laundry from a change (a difference between a water level when water is put and a water level after a predetermined time elapses) in water level in the inside of the tub 20 and the absorption data. Detection of a water level may be performed based on internal water pressure of the tub 20, and the water level when water is put may be calculated from an amount of water put in the tub 20.

The driving condition decider 64 may decide a rotation direction or rpm of each of the drum 30 and the pulsator 40 based on at least one of the determination results. The determination may be performed during washing operation, as well as when washing operation starts. Also, the determination may be performed during rinsing operation.

Generally, a washing process may be divided into operations of "washing", "rinsing", and "dehydrating".

Between washing operation and rinsing operation, or between successive rinsing operations when there are two or more rinsing operations, dehydrating operation called intermediate dehydrating may be performed. Although torque is needed to rotate the drum 30 or the pulsator 40, washing operation, rinsing operation, and dehydrating operation may require different magnitudes of torque. Generally, washing operation and rinsing operation require great torque, and dehydrating operation does not require great torque.

Accordingly, when dehydrating is performed, power supply to the motor 50 for driving the pulsator 40 may be stopped, and only the drum 30 may rotate in the state in which the pulsator 40 rotates by the force of inertia. Thereby, power consumption for rotating the pulsator 40 may be not needed, which reduces total power consumption. However, in this case, if the state of laundry changes abruptly when the drum 30 and the pulsator 40 rotate at different rpms, the laundry may be damaged.

Accordingly, as a countermeasure, it may be preferable to change the magnetization of the motor 50 for driving the drum 30. Thereby, although the drum 30 and the pulsator 40 rotate simultaneously, power consumption may be suppressed. For example, when dehydrating operation starts or when dehydrating operation is performed, the motor 50 may be demagnetized after laundry reaches a stable state (a state in which the drum 30 rotates at about 60 rpm to about 120 rpm), and the magnetization of the motor 50 may be reduced, thereby reducing power consumption when the motor 50 rotates at high speed.

<Effect of the Washing Machine 1>

Effects of the washing machine 1 will be described compared to the typical washing machines (drum type washing machines of Patent Documents 1 and 2), below.

Since the washing machine 1 does not require a drum of a large structure, unlike the typical washing machines, it may be possible to enlarge the capacity of the drum 30 and to suppress manufacturing cost or running cost.

The washing machine 1 may have no need for installing a sub drum in a main drum and making a gap between the main drum and the sub drum. The washing machine 1 may cause laundry to enter such a gap to improve washing power. Thereby, it may be possible to increase the capacity of the drum, and to implement a compact washing machine capable of corresponding to a recently required large capacity.

The washing machine 1 may obtain three-dimensional movements of laundry by rotating the drum 30 and the pulsator 40 at different rpms, unlike the typical washing machines of implementing three-dimensional movements of laundry by combining two-dimensional movements of laundry obtained by changing the rpms or rotation directions of the main drum and the sub drum with movements by rotations of all the drums. Preferably, the washing machine 1 may obtain three-dimensional movements of laundry by rotating the drum 30 and the pulsator 40 in opposite directions. More preferably, the washing machine 1 may rotate the pulsator 40 at higher speed than the drum 30 to thereby obtain greater three-dimensional movements of laundry.

The main drum and the sub drum of the typical washing machines could not provide laundry with greater mechanical power than that provided by beating washing of typical drum type washing machines, and therefore a significant improvement of a washing effect could not be expected. In contrast, since the washing machine 1 rotates the pulsator 40 at higher rpm than that of the drum 30 and performs "washing" using the centrifugal force of the drum 30 and the mechanical power of the pulsator 40, the washing machine 1 may use all effects of: beating washing; beating washing of beating laundry with the protrusions 45 of the pulsator 40; rubbing washing of rubbing laundry; and reducing stains through mixing of laundry.

Also, the protrusions 45 of the pulsator 40 may function as so-called lifters. Accordingly, the washing machine 1 may omit lifters disposed on the inner circumferential surface of the drum 30, unlike the typical washing machines.

The effects may appear more significantly when the washing machine 1 washes a large amount of laundry. That is, in the typical washing machines, when the amount of laundry increases, the remaining capacity of the drum capable of providing mechanical power becomes insufficient. To overcome the problem, the typical washing machines secure washing performance by increasing a time for which laundry is immersed in washing water, that is, by increasing a washing time. In contrast, since the washing machine 1 obtains the above-described effects, the washing machine 1 suppress washing time extension to the minimum.

The typical washing machines use a centrifugal force through a high-speed rotation, and obtain the same effects with respect to laundry located at the border of the main drum and the sub drum. However, the typical washing machines cannot provide mechanical power to laundry located away from the border since the laundry is stuck on the drum.

Also, to drive both the main drum and the sub drum, the typical washing machines require greater power than the washing machine 1. When the sub drum is larger than the pulsator 40, the sub drum has a greater force of inertia, and requires higher torque accordingly. Furthermore, the individual drums also require torque for raising laundry. Also, torque for canceling a counterforce generated at the border between the main drum and the sub drum is needed, and therefore, a high-output motor is needed.

Generally, to implement the high output of a motor, it is necessary to increase the thickness of a stator core or a rotor core or to use a magnet with a strong magnetic force. Since increasing the thickness of the stator core or the rotor core accompanies an increase in thickness of the motor, there is a problem of increasing the size of the washing machine or decreasing the capacity of the drum. Either way, it is inevitable to increase manufacturing cost or running cost.

In contrast, in the washing machine 1, since the pulsator 40 needs little power for raising laundry and the force of inertia of the pulsator 40 is also low, power consumption may be suppressed. Also, the washing machine 1 may miniaturize the motor 50, and enlarge the capacity of the drum 30.

<Details about the Motor>

As shown in FIG. 2, the motor 50 may have an outer appearance of a flat cylinder whose diameter is smaller than that of the tub 20, and the motor 50 may be attached on the bearing housing 23*a* of the tub 20 such that the rotation axis J passes through the center of the motor 50. The motor 50 may be configured with the outer rotor 53 (second rotor), the inner rotor 52 (first rotor), the inner shaft 71, the outer shaft 72, the stator 51, etc.

Also, the outer rotor 53 and the inner rotor 52 may be connected to the pulsator 40 or the drum 30 without a clutch or an accelerator/decelerator in between, to drive the pulsator 40 or the drum 30.

The two rotors 52 and 53 may be driven and controlled by a single inverter. The outer rotor 53 and the inner rotor 52 may share a coil 163 of the stator 51, and when current is supplied to the coil 163, the outer rotor 53 and the inner rotor 52 may rotate independently. In the case of the motor 50, ratios of the rpms of the rotors 52 and 53 when the rotors 52 and 53 rotate in the same direction and when the rotors 52 and 53 rotate in opposite directions may be fixed values, such as, for example, 1:1 and 1:−2. Switching between a rotation in the same direction and a rotation opposite directions may be performed by magnetization, and the ratio of the rpms upon the rotation in the same direction may be different from the ratio of the rpms upon the rotation in the opposite directions.

The outer rotor 53 may be a cylindrical member having a flat bottom, and include a lower wall portion 121 having a center opening, a rotor yoke 122 extending from an edge of the lower wall portion 121, and a plurality of outer magnets 124 that are a plurality of permanent magnets formed in an arc shape. The lower wall portion 121 and the rotor yoke 122 may be formed by pressing a steel plate to function as back yokes.

In the current embodiment, the outer rotor 53 may be a consequent type rotor, wherein 16 outer magnets 124 may be arranged such that S pole appear at intervals along the circumferential direction of the outer rotor 53, and the 16 outer magnets 124 may be fixed on an inner surface of the rotor yoke 122. Also, by reversing the magnetic poles of the outer magnets 124, the number of magnetic poles of the outer rotor 53 may be converted between 16 and 32.

The inner rotor 52 may be a flat cylindrical member whose external diameter is smaller than that of the outer rotor 53, and include an inner support wall portion 131 having a center opening, an inner side wall portion 132 extending from an edge of the inner support wall portion 131, and a plurality of inner magnets 134 that are a plurality of permanent magnets formed in the shape of a rectangular plate.

In the current embodiment, the inner rotor 52 may be a spoke type rotor, wherein 32 inner magnets 134 may be arranged radially at intervals along the circumferential direction of the inner rotor 52, and fixed on the inner side wall 132. A rotor core 133 may be positioned between the inner magnets 134 along the circumferential direction.

The inner shaft 71 may be a shaft member formed in the shape of a cylinder, and rotatably supported on the bearing housing 23*a* through the inner bearing 73, the outer shaft 72, and the outer bearings 74. A lower end of the inner shaft 71 may be connected to the outer rotor 53. An upper end of the inner shaft 71 may be connected to the pulsator 40.

The outer shaft 72 may be a cylindrical shaft member which is shorter than the inner shaft 71 and whose internal diameter is greater than the external diameter of the inner shafter 71, and the outer shaft 72 may be rotatably supported on the bearing housing 23*a* through the inner bearings 73, the inner shaft 71, and the outer bearings 74. The lower end of the outer shaft 72 may be supported on the shaft support 24, and the upper end of the outer shaft 72 may be connected to the flange shaft 34 of the drum 30.

Figure 11:
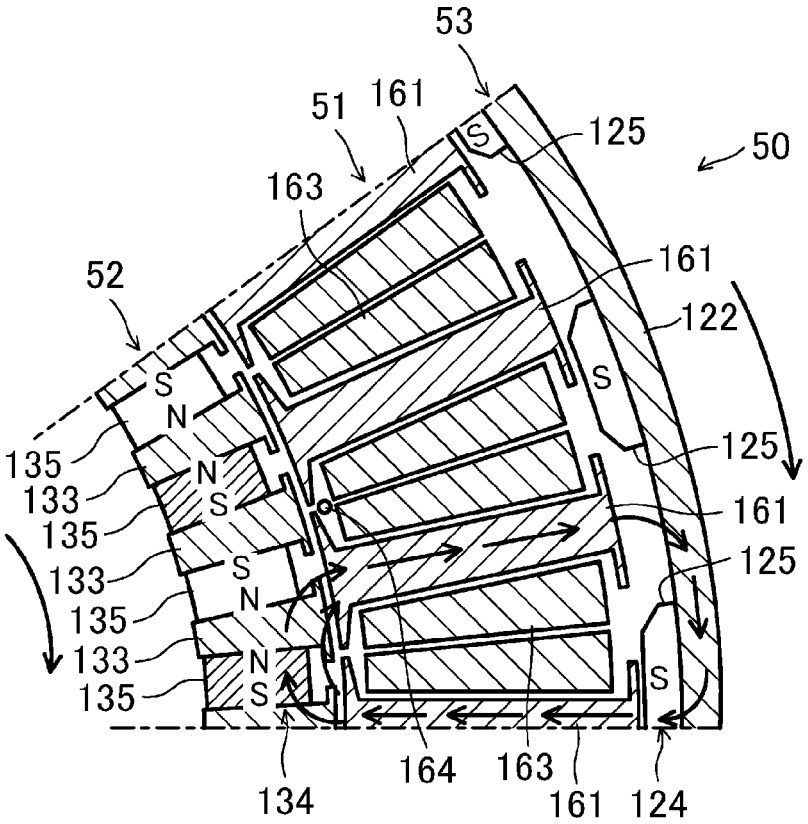
FIG. 11 is a cross-sectional view showing a configuration of a motor, wherein an outer rotor has 32 magnetic poles.

The stator 51 may be a ring-shaped member whose external diameter is smaller than the internal diameter of the outer rotor 53 and whose internal diameter is greater than the external diameter of the inner rotor 52. In the stator 51, a plurality of teeth 161 or coils 163 may be embedded in a resin, as shown in FIG. 11. In the stator 51 according to the current embodiment, 24 I-shaped teeth 161 and coils 163 may be embedded.

The teeth 51 may be a thin plate steel member having a cross section of a I-shaped form, and the teeth 51 may be independently arranged radially at equidistant intervals along the entire circumference of the stator 51. The inner and outer circumferential ends of the teeth 161 may protrude in the shape of a flange in the circumferential direction of the stator 51.

The teeth 161 may be wound by three wires covered by an insulator with an insulator interposed therebetween in a predetermined order and configuration so that the coil 163 is formed on each tooth 161. A group of teeth 161 on which the coils 163 are formed may be embedded in thermosetting resin by molding in the state in which the side ends in diameter direction of the teeth 161 are exposed, and fixed with a predetermined arrangement in the state of being insulated.

The stator 51, the inner rotor 52, and the outer rotor 53 may be assembled such that the ends of the teeth 161 towards the inner rotor 52 face the rotor core 133 with a small gap, and the ends of the teeth 161 towards the outer rotor 53 face the outer magnets 124 with a small gap.

A position sensor 164 may be interposed between the neighboring teeth 161. The position sensor 164 may be disposed adjacent to the inner rotor 52 to recognize a position of the inner rotor 52.

Figure 12:
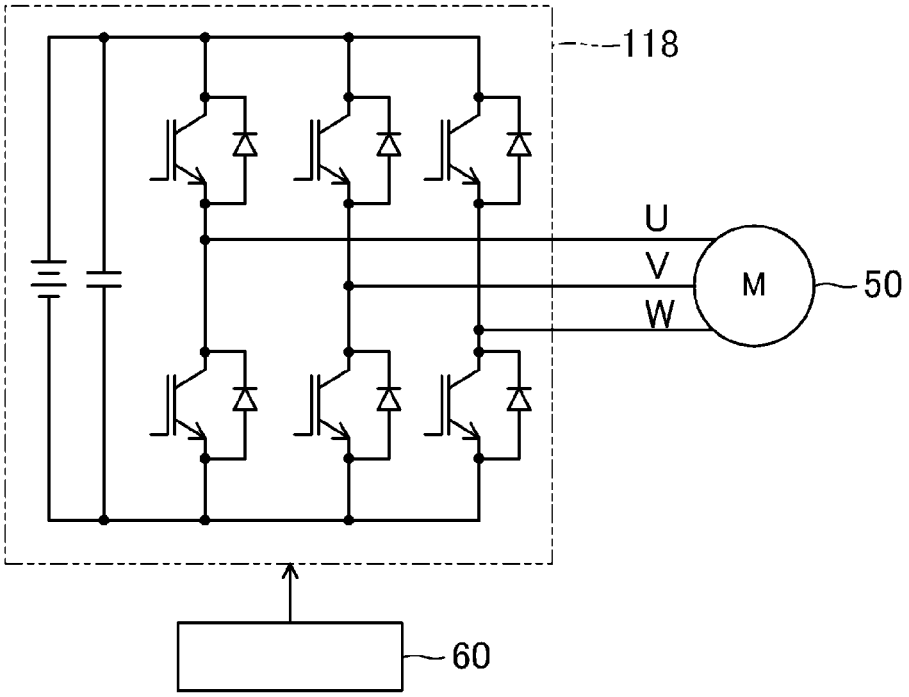
FIG. 12 is a circuit diagram showing a configuration of an inverter.

As shown in FIG. 12, the motor 50 may be connected to a three-phase inverter 118. In the motor 50, when power is supplied to the coils 163 of the stator 51, the outer and inner sides of the teeth 161 may be respectively charged with different polarities, and according to a rotating magnetic field, the outer rotor 53 and the inner rotor 52 may rotate independently.

As such, the outer rotor 53 and the inner rotor 52 may share the stator 51, and rotate in a plurality of rotation modes by the single inverter 118.

(Operation of Converting the Number of Poles)

FIG. 11 is a cross-sectional view showing a main configuration of a motor at a mechanical angle of 45°. All of the outer magnets 124 may be convertible magnets 125. All of the inner magnets 134 may be fixed magnets 135.

The convertible magnets 125 may be magnets whose polarity is reversed when magnetizing current is suppled to the coils 163 as a number-of-poles converting portion. Also, the fixed magnets 135 may be magnets whose polarity is not reversed even when magnetizing current is supplied to the coils 163. There is no need for depending on the magnitude of a coercive force (which will be described later) or the kind of magnets. Herein, "reversed" and "not reversed" may be determined based on the total polarity of the magnets, and determined based on total magnetic flux although a reversed polarity appears in some parts.

In the current embodiment, the number St of poles of the stator 51 may be 24, the number of poles of the inner rotor 52 may be 32, and the maximum number of poles of the outer rotor 53 may be 32, wherein St:m=3:4. The number of poles of the outer rotor 53 may be converted between 32 and 16 by magnetization.

As shown in FIG. 11, the outer magnets 124 may be arranged at intervals in the circumferential direction such that the surfaces of the outer magnets 124 toward the teeth 161 become S pole. By arranging the outer magnets 124 in this manner, the rotor yoke 122 of the outer rotor 53 adjacent to the outer magnets 124 that are S pole may become N pole, and the number of poles of the outer rotor 53 may become 32. Since the N pole of the rotor yoke 122 is not a protruding pole structure, magnetic resistance between the rotor yoke 122 and the teeth 161 may become nearly uniform. By using the consequent type rotor without a protruding pole structure, vibrations or noise may be suppressed.

Figure 13:
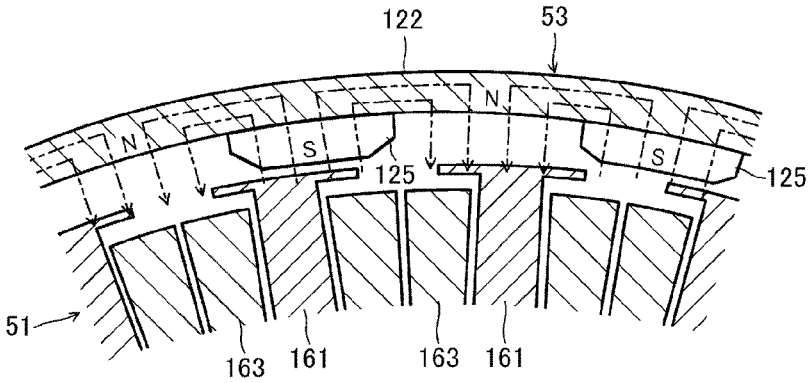
FIG. 13 is a cross-sectional view showing a moving path of magnetic flux.

As shown in FIG. 13, magnetic flux exiting the N pole of the rotor yoke 122 may pass through the inner rotor 52 via the teeth 161, enter the S pole of the outer magnets 124 via the teeth 161, and then pass through the rotor yoke 122 to return to the N pole of the rotor yoke 122.

When the number of poles of the outer rotor 53 is 32, an air gap which is a gap between the N-pole rotor yoke 122 of the outer rotor 53 and the teeth 161 may be large so that an induced voltage may be reduced. For this reason, when dehydrating operation requiring high speed and low torque is performed, it may be preferable to set the number of poles of the outer rotor 53 to 32.

Figure 14:
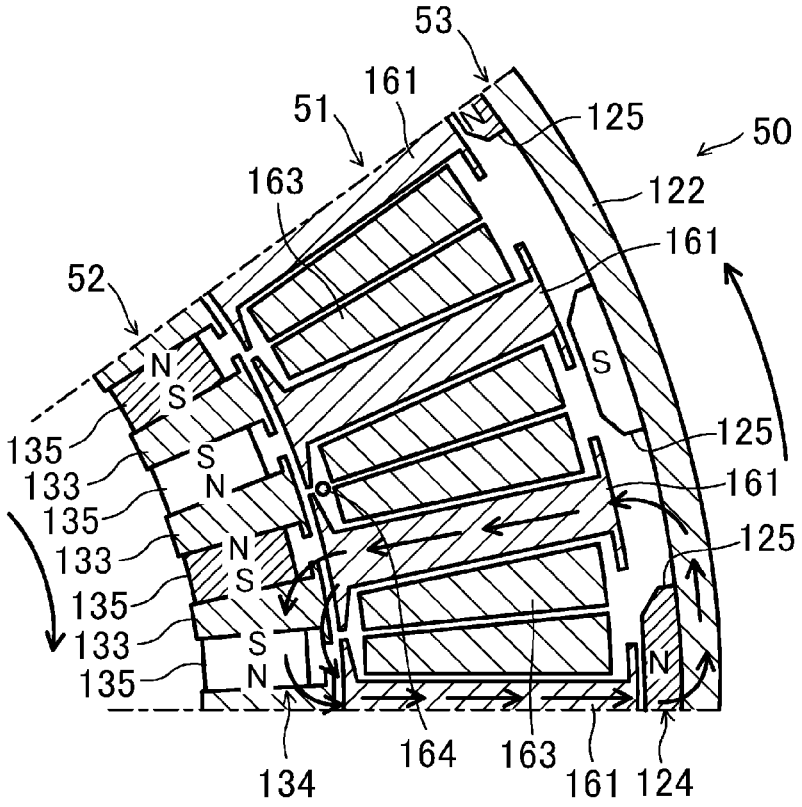
FIG. 14 is a cross-sectional view showing a configuration of a motor, wherein an outer rotor has 16 magnetic poles.

Meanwhile, by supplying magnetizing current to the coils 163 to reverse some magnetic poles of the outer magnets 124 such that N pole and S pole appear alternately at intervals in the circumferential direction, as shown in FIG. 14, the number of poles of the outer rotor 53 may become 16.

Figure 15:
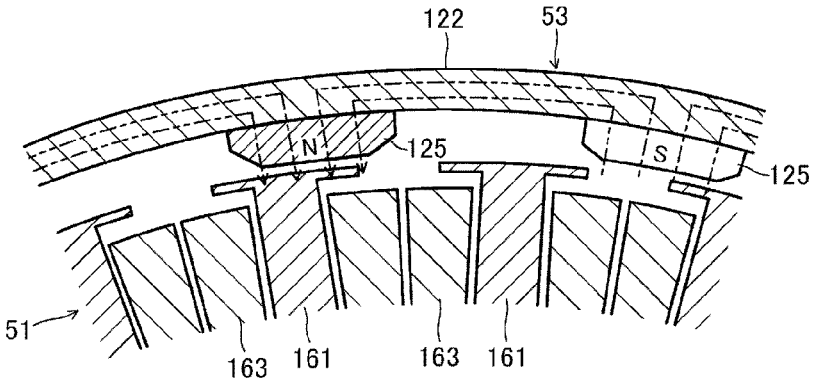
FIG. 15 is a cross-sectional view showing a moving path of magnetic flux.

As shown in FIG. 15, magnetic flux exiting the N poles of the outer magnet 124 may pass through the inner rotor 52 through the teeth 161, enter the S poles of the outer magnets 124 via the teeth 161, and then return to the N poles of the outer magnets 124 through the rotor yoke 122.

When the number of poles of the outer rotor 53 is 16, an air gap which is a gap between the N-pole outer magnet 124 and the teeth 161 may be smaller than that when the number of poles of the outer rotor 53 is 32, and accordingly, an induced voltage may increase. For this reason, when washing operation requiring low speed and high torque is performed, it may be preferable to set the number of poles of the outer rotor 53 to 16.

Hereinafter, a method for converting the number of poles of the outer magnets 124 from 32 to 16 will be described with reference to FIG. 11. FIG. 11 shows 32 poles, however, the 32 poles may be converted to 16 poles by reversing the magnetic pole of the lowermost magnet from S pole to N pole. Magnetizing current may be supplied to the coils 163 such that a magnetic field flows through the lowermost tooth 161 and the lower second tooth 161 as indicated by arrows of FIG. 11. Accordingly, the magnetic pole of the lowermost outer magnet 124 may be reversed from S pole to N pole.

Successively, a method for converting the number of poles of the outer magnets 124 from 16 to 32 will be described with reference to FIG. 14. FIG. 14 shows 16 poles, however, the 16 poles may be converted to 32 poles by reversing the magnetic pole of the lowermost magnet from N pole to S pole. Magnetizing current may be supplied to the coils 163 such that a magnetic field flows through the lowermost tooth 161 and the lower second tooth 161 as indicated by arrows of FIG. 14. Accordingly, the magnetic pole of the lowermost outer magnet 124 may be reversed from N pole to S pole.

Also, in the case of the arrangement of the outer magnets 124 as shown in FIG. 14, there may be a case in which the pole in front of the lowermost outer magnet 124 remains. However, by appropriately adjusting an angle of the outer rotor 53, that is, the phase of magnetizing current supplied to the coils 163 to perform magnetization several times, as necessary, magnetization may be completely reversed.

As such, by appropriately setting a magnetic path of magnetic flux for magnetization, pole reversion of only the convertible magnets 125 may be stably performed, for example, even when the convertible magnets 125 and the fixed magnets 135 are ferrite magnets having the same coercive force.

Also, the convertible magnets 125 and the fixed magnets 135 may be two or more kinds of magnets having different coercive forces. For example, by increasing the coercive force of the fixed magnets 135 rather than that of the convertible magnets 125, more stable magnetization may be achieved. Also, by using rare earth magnets as the fixed magnets 135 of the inner rotor 52, torque balance of the inner rotor 52 and the outer rotor 53 may be more easily adjusted.

Figure 16:
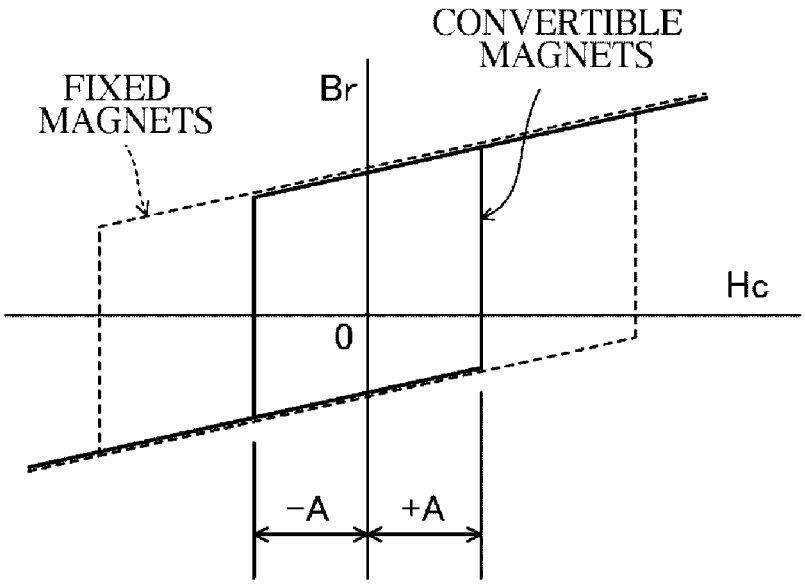
FIG. 16 shows a B-H curve when magnets having different coercive forces are used as fixed magnets and convertible magnets.

FIG. 16 shows a B-H curve (a magnetic hysteresis curve) when magnets having different coercive forces are used as the fixed magnets 135 and the convertible magnets 125. By supplying magnetizing current to the coils 163 to generate a magnetic field that is greater than or equal to +A and smaller than or equal to −A and that does not exceed the coercive force of the fixed magnets 135, the poles of the convertible magnets 125 may be reversed, as seen from the drawing. The magnetizing current may be pulse current, and magnetization may be possible within about several tens of milliseconds.

However, to magnetize the convertible magnets 125, a high voltage may be applied to the coils 163 to raise magnetizing current. Also, when a high-speed rotation is performed, for example, when dehydrating operation is performed, a high voltage will be advantageous. However, when a low-speed rotation is performed with low torque, for example, when washing operation or rinsing operation is performed, a voltage which is not excessively high may be preferably used in view of the efficiency of the inverter 118.

Accordingly, in the current embodiment, upon magnetization and dehydrating, a high voltage may be supplied to the inverter 118, whereas upon washing, a voltage that is lower than that supplied upon magnetization may be supplied to the inverter 118. Thereby, consumption power may be reduced.

(Rotation Mode)

Operation of supplying magnetizing current to the coils 163 to reverse the magnetic poles of the convertible magnets 125 and convert the number of poles may be performed by the controller 60. That is, the outer rotor 53 and the inner rotor 52 may rotate in a plurality of rotation modes based on a control instruction from the controller 60.

Figure 17:
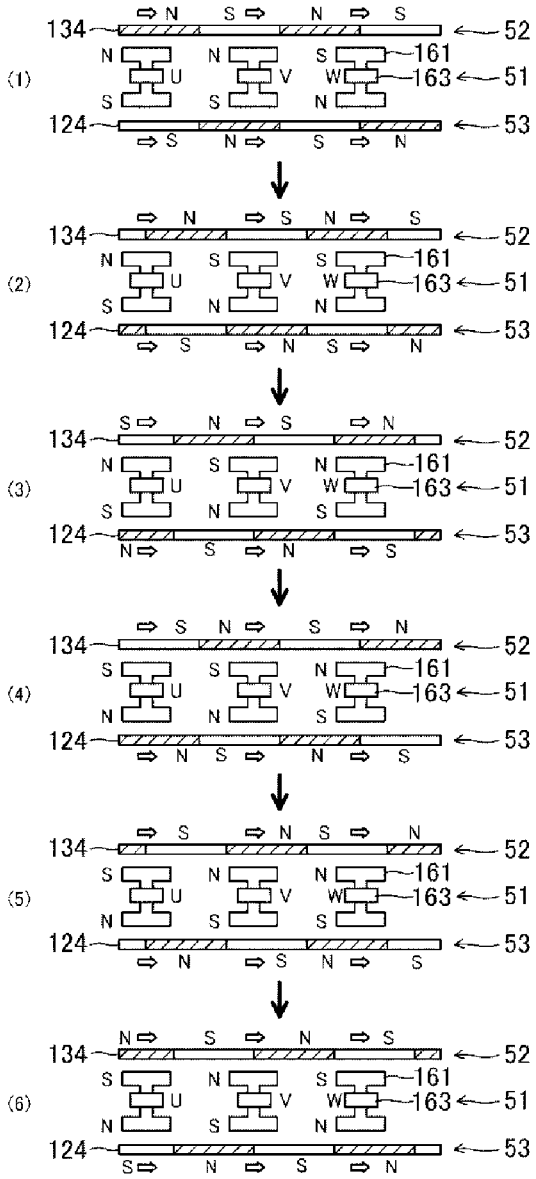
FIG. 17 is a view for describing a rotation mode when an outer rotor has 32 magnetic poles.

FIG. 17 shows positions of the stator 51, the outer rotor 53, and the inner rotor 52 in an electrical angle of 360°, divided to 6 steps, when a three-phase motor rotates. FIG. 17 illustrates a rotation principle of the outer rotor 53 and the inner rotor 52.

FIG. 17, the outer rotor 53 and the inner rotor 52 may have the same 32 poles, and FIG. 17 shows the mechanical angle of 45°. When driving current is supplied to the three-phase coils 163 of U phase, V phase, and W phase, magnetic polarities may be generated in the teeth 161. Opposite magnetic polarities may be generated in a part of the teeth 161 toward the inner rotor 52 and in a part of the teeth 161 toward the outer rotor 53.

In first step of FIG. 17, the parts of the teeth 161 of U and V phases toward the inner rotor 52 may be N pole, and the part of the teeth 161 of W phase toward the inner rotor 52 may be S pole. Accordingly, the parts of the teeth 161 of U and V phases toward the outer rotor 53 may be S pole, and the part of the teeth 161 of W phase toward the outer rotor 53 may be N pole. Also, in the following description, the poles of the teeth 161 toward the inner rotor 52 will be described.

In the first step, the outer rotor 53 and the inner rotor 52 may receive a force rotating in the right direction of FIG. 17 as torque when there is a shift of 180° in electrical angle.

In second step, the pole of the teeth 161 of V phase may be reversed. Accordingly, when the part of the teeth 161 of U phase toward the inner rotor 52 is N pole, the part of the teeth 161 of V phase toward the inner rotor 52 becomes S pole, and the part of the teeth 161 of W phase toward the inner rotor 52 is S pole, the outer rotor 53 and the inner rotor 52 may move in the right direction.

In third step, the pole of the teeth 161 of W phase may be reversed. Accordingly, when the part of the teeth 161 of U phase toward the inner rotor 52 is N pole, the part of the teeth 161 of V phase toward the inner rotor 52 is S pole, and the part of the teeth 161 of W phase toward the inner rotor 52 becomes N pole, the outer rotor 53 and the inner rotor 52 may move in the right direction.

In fourth step, the pole of the teeth 161 of U phase may be reversed. Accordingly, when the part of the teeth 161 of U phase toward the inner rotor 52 becomes S pole, the part of the teeth 161 of V phase toward the inner rotor 52 is S pole, and the part of the teeth 161 of W phase toward the inner rotor 52 is N pole, the outer rotor 53 and the inner rotor 52 may move in the right direction.

In fifth step, the pole of the teeth 161 of V phase may be reversed. Accordingly, when the part of the teeth 161 of U phase toward the inner rotor 52 is S pole, the part of the teeth 161 of V phase toward the inner rotor 52 becomes N pole, and the part of the teeth 161 of W phase toward the inner rotor 52 is N pole, the outer rotor 53 and the inner rotor 52 may move in the right direction.

In sixth step, the pole of the teeth 161 of W phase may be reversed. Accordingly, when the part of the teeth 161 of U phase toward the inner rotor 52 is S pole, the part of the teeth 161 of V phase toward the inner rotor 52 is N pole, and the teeth of the teeth 161 of W phase toward the inner rotor 51 becomes S pole, the outer rotor 53 and the inner rotor 52 may move in the right direction.

As such, the outer rotor 53 and the inner rotor 52 may rotate at the same rpm in the same direction. In the current embodiment, the rotation mode is referred to as a synchronous rotation mode. Also, there may be a case in which the phases of the outer rotor 53 and the inner rotor 52 are more or less shifted due to a load or a load change. However, the example of FIG. 17 is illustrated under an assumption that there is no phase shift.

Figure 18:
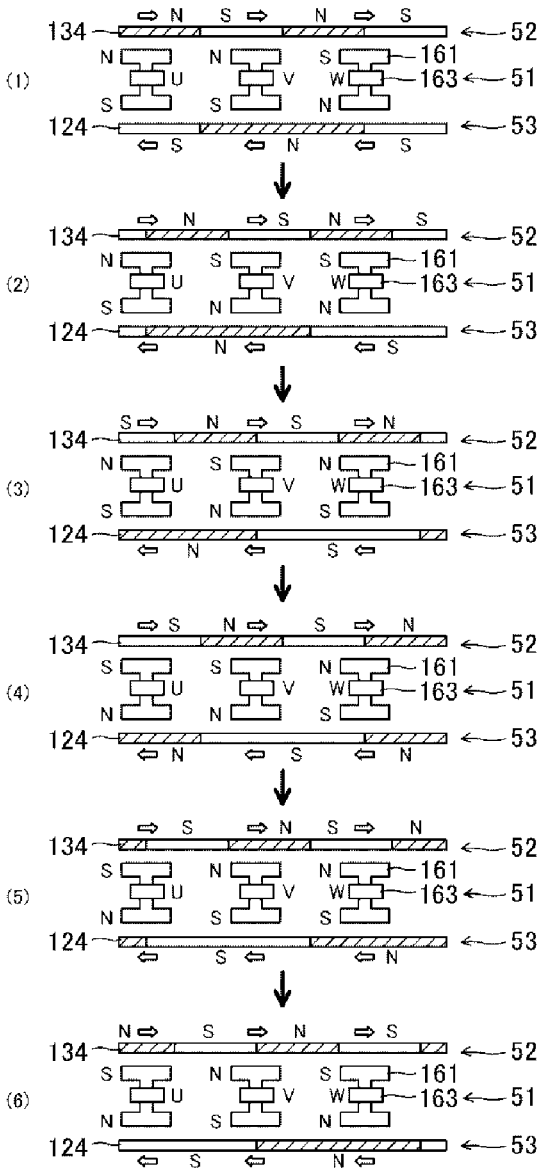
FIG. 18 is a view for describing a rotation mode when an outer rotor has 16 magnetic poles.

Hereinafter, a rotation mode when the number of poles of the outer rotor 53 is converted will be described with reference to FIG. 18. As shown in FIG. 18, the outer rotor 53 has 16 poles, and the inner rotor 52 has 32 poles.

In first step of FIG. 18, the parts of the teeth 161 of U and V phases toward the inner rotor 52 may be N pole, and the part of the teeth 161 of W phase toward the inner rotor 52 may be S pole. Accordingly, the parts of the teeth 161 of U and V phases toward the outer rotor 53 may be S pole, and the part of the teeth 161 of W phase toward the outer rotor 53 may be N pole.

In the first step, the inner rotor 52 may receive a force rotating in the right direction of FIG. 18 as torque. Meanwhile, the outer rotor 53 may receive a force rotating in the left direction of FIG. 18 as torque.

In second step, the pole of the teeth 161 of V phase may be reversed. Accordingly, when the part of the teeth 161 of U phase toward the inner rotor 52 is N pole, the part of the teeth 161 of V phase toward the inner rotor 52 becomes S pole, and the part of the teeth 161 of W phase toward the inner rotor 51 is S pole, the inner rotor 52 may move in the right direction, and the outer rotor 53 may move in the left direction.

In third step, the pole of the teeth 161 of W phase may be reversed. Accordingly, when the part of the teeth 161 of U phase toward the inner rotor 52 is N pole, the part of the teeth 161 of V phase toward the inner rotor 52 is S pole, and the teeth 161 of W phase toward the inner rotor 52 becomes N pole, the inner rotor 52 may move in the right direction, and the outer rotor 53 may move in the left direction.

In fourth step, the pole of the teeth 161 of U phase may be reversed. Accordingly, when the part of the teeth 161 of U phase toward the inner rotor 52 becomes S pole, the part of the teeth 161 of V phase toward the inner rotor 52 is S pole, and the part of the teeth 161 of W phase toward the inner rotor 52 is N pole, inner rotor 52 may move in the right direction, and the outer rotor 53 may move in the left direction.

In fifth step, the pole of the teeth 161 of V phase may be reversed. Accordingly, when the part of the teeth 161 of U phase toward the inner rotor 52 is S pole, the part of the teeth 161 of V phase toward the inner rotor 52 becomes N pole, and the part of the teeth 161 of W phase toward the inner rotor 52 is N pole, the inner rotor 52 may move in the right direction, and the outer rotor 53 may move in the left direction.

In sixth step, the pole of the teeth 161 of W phase may be reversed. Accordingly, when the part of the teeth 161 of U phase toward the inner rotor is S pole, the part of the teeth 161 of V phase toward the inner rotor 52 is N pole, and the part of the teeth 161 of W phase toward the inner rotor 52 becomes S pole, the inner rotor 52 may move in the right direction, and the outer rotor 53 may move in the left direction. At this time, an amount of movement of the outer rotor 53 may be twice that of the inner rotor 52.

As such, the outer rotor 53 and the inner rotor 52 may rotate at different rpms in different directions. In the current embodiment, the rotation mode is referred to as an opposite rotation mode.

Also, by combining the numbers of poles, various rotation modes of different rpms from those of the synchronous rotation mode and the opposite rotation mode or of the same rpms as those of the synchronous rotation mode and the opposite rotation mode may be implemented. As such, the synchronous rotation mode and the opposite rotation mode may include rotation modes for rotating the outer rotor 53 and the inner rotor 52 at arbitrary rpms or with different torque, by rotating the outer rotor 53 and the inner rotor 52 at different rpms in the same direction or in different directions.

As described above, according to the motor 5, the inverter 118 may rotate the outer rotor 53 and the inner rotor 52 in a plurality of rotation modes through a simple configuration. That is, unlike the typical technique requiring a plurality of inverters for rotating two rotors independently, the small-sized inverter 118 may be used, thereby implementing a compact product or achieving a cost reduction.

(Modified Example 1 of Motor)

Figure 19:
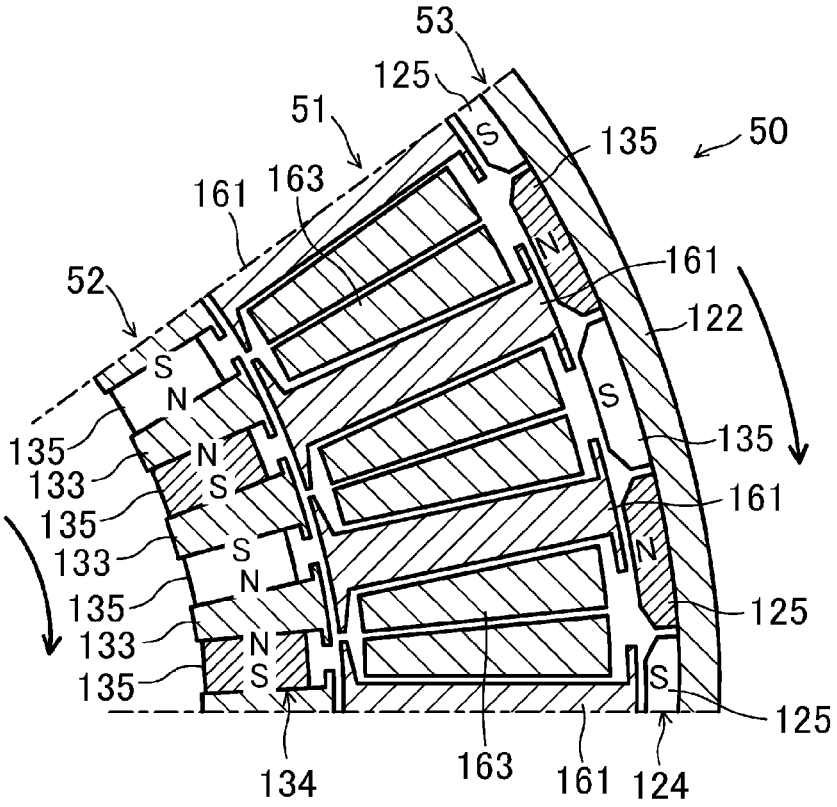
FIG. 19 is a cross-sectional view showing a configuration of a motor according to Modified Example 1, wherein an outer rotor has 32 magnetic poles.

FIG. 19 is a cross-sectional view showing a configuration of a motor according to Modified Example 1. In the following description, the same components as the corresponding ones of the above-described embodiment will be assigned the same reference numerals, and only different components from components of the above-described embodiment will be described.

As shown in FIG. 19, the inner rotor 52 may be a spoke type rotor, wherein 32 inner magnets 134 may be arranged radially at intervals along the circumferential direction of the inner rotor 52, and fixed on the inner side wall portion 132. The inner magnets 134 may be all fixed magnets 135. A rotor core 133 may be disposed between the inner magnets 134 along the circumferential direction.

The outer rotor 53 may be a SPM type rotor, wherein 32 outer magnets 124 may be arranged such that N pole and S pole appear alternately in the circumferential direction of the outer rotor 53, and the outer magnets 124 may be fixed on the inner surface of the rotor yoke 122.

The outer magnets 124 may be configured with convertible magnets 125 and fixed magnets 135. More specifically, the lowermost, second lower, and fifth lower magnets among five outer magnets 124 shown in FIG. 19 may be convertible magnets 125. Also, the third lower and fourth lower magnets may be fixed magnets 135. That is, two neighboring magnets may be magnets of the same function.

Figure 20:
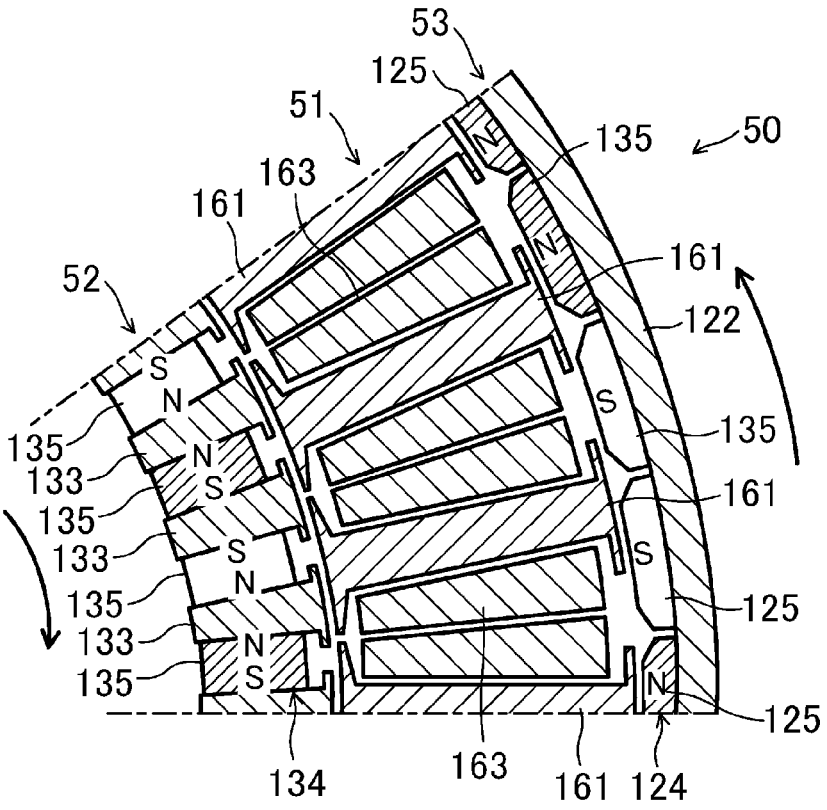
FIG. 20 is a cross-sectional view showing a configuration of a motor, wherein an outer rotor has 16 magnetic poles.

Also, when magnetizing current is supplied to the coils 163 to reverse the poles of all the convertible magnets 125, the lowermost and fifth lower convertible magnets 125 may be reversed from S pole to N pole, and the second lower convertible magnet 125 may be reversed from N pole to S pole, as shown in FIG. 20. As such, by reversing the poles of the convertible magnets 125 to arrange a group of two neighboring S-pole magnets and a group of two neighboring N-pole magnets alternately along the circumferential direction, the number of poles of the outer rotor 53 may become 16.

If driving current is supplied to the coils 163 when the number of poles of the outer rotor 53 is 32, both the outer rotor 53 and the inner rotor 52 may rotate in a clockwise direction, as indicated by arrows in FIG. 19. That is, the outer rotor 53 and the inner rotor 52 may rotate in the synchronous rotation mode.

Meanwhile, if driving current is supplied to the coils 163 when the outer rotor 53 has 16 poles, the outer rotor 53 may rotate in the counterclockwise direction, and the inner rotor 52 may rotate in the clockwise direction, as indicated by arrows in FIG. 20. That is, the outer rotor 53 and the inner rotor 52 may rotate in the opposite rotation mode.

Also, the numbers of the inner magnets 134 and the outer magnets 124 are exemplary, and the numbers of the inner magnets 134 and the outer magnets 124 are not limited to the example. Also, the outer magnets 124 may be configured with the convertible magnets 125 and the fixed magnets 135. However, all of the outer magnets 124 may be configured with the convertible magnets 125. In this case, by reversing the poles of an arbitrary half of the convertible magnets 125, the number of poles may be converted. Thereby, magnetization switching may be done without distinguishing the convertible magnets 125 from the fixed magnets 35.

(Modified Example 2 of Motor)

Figure 21:
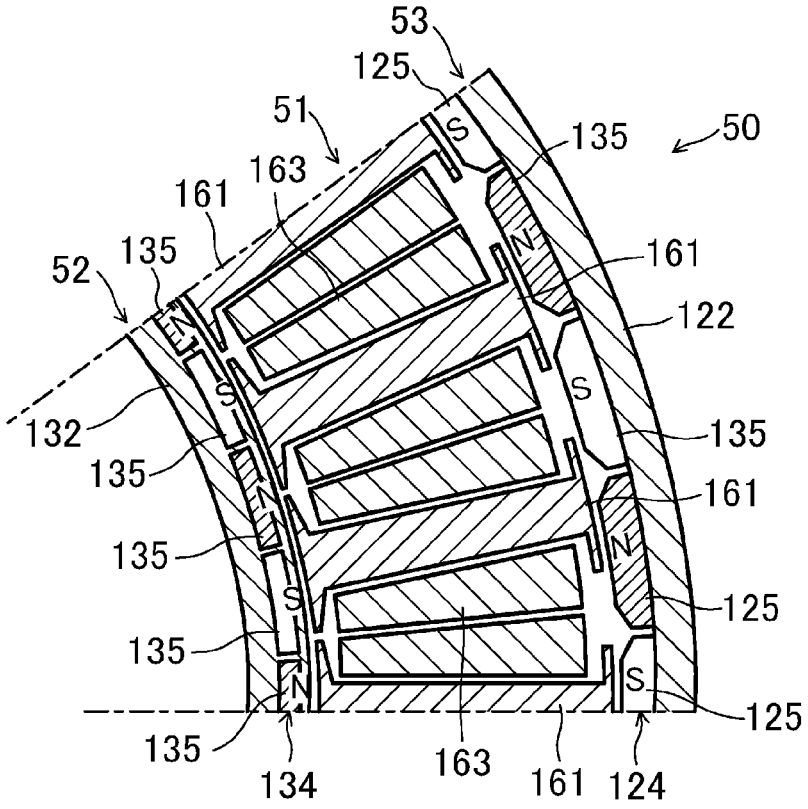
FIG. 21 is a cross-sectional view showing a configuration of a motor according to Modified Example 2.

FIG. 21 is a cross-sectional view showing a configuration of a motor according to Modified Example 2. As shown in FIG. 21, the inner rotor 52 may be an embedded type SPM rotor, wherein 32 inner magnets 134 are arranged such that S pole and N pole appear alternately in the circumferential direction, and the inner magnets 134 may be embedded in the inner side wall portion 132. The inner magnets 134 may be all fixed magnets 135.

The outer rotor 53 may be a SPM type rotor, wherein 32 outer magnets 124 may be arranged such that S pole and N pole appear alternately in the circumferential direction, and the outer magnets 124 may be fixed on an inner surface of the rotor yoke 122. Also, although the outer magnets 124 are configured with the convertible magnets 125 and the fixed magnets 135, the arrangement of the outer magnets 124 may be the same as in Modified Example 1, and accordingly, a detailed description thereof will be omitted.

(Modified Example 3 of Motor)

Figure 22:
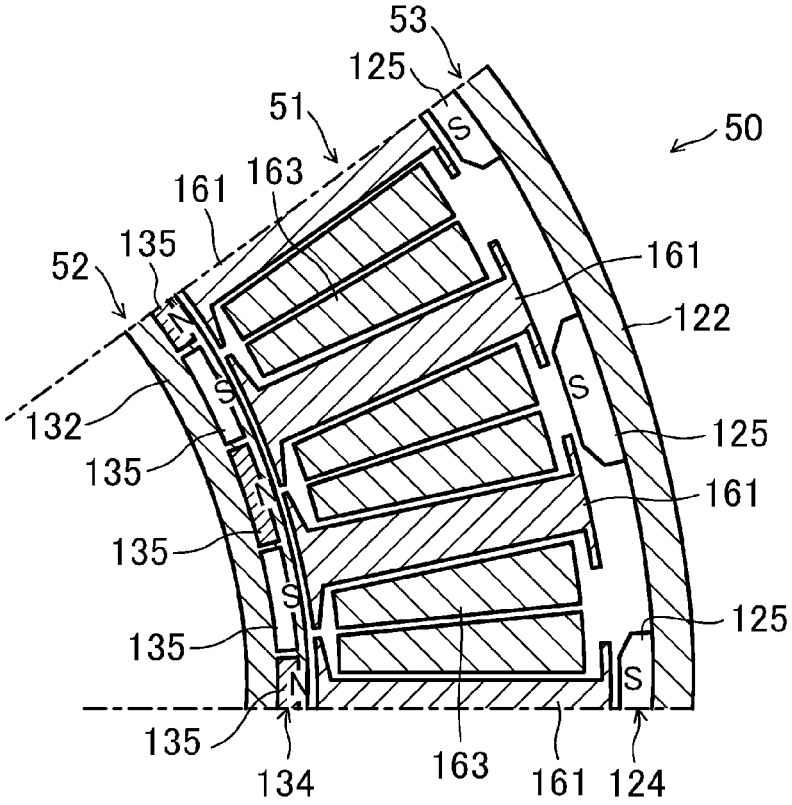
FIG. 22 is a cross-sectional view showing a configuration of a motor according to Modified Example 3.

FIG. 22 is a cross-sectional view showing a configuration of a motor according to Modified Example 3. As shown in FIG. 22, the inner rotor 52 may be an embedded type SPM rotor, wherein 32 inner magnets 134 are arranged such that N pole and S pole appear alternately in the circumferential direction, and the inner magnets 134 may be embedded in the inner side wall portion 132. The inner magnets 134 may be all fixed magnets 135.

The outer rotor 53 may be a consequent type rotor, wherein 16 outer magnets 124 may be arranged such that S pole appear at intervals along the circumferential direction of the outer rotor 53, and the outer magnets 124 may be fixed on an inner surface of the rotor yoke 122. The outer magnets 124 may be all convertible magnets 125. Also, by reversing the magnetic poles of the convertible magnets 125, the number of magnetic poles of the outer rotor 53 may be converted between 16 and 32. Also, a method of reversing the poles of the convertible magnets 125 has been described in the above embodiment, and therefore, a detailed description thereof will be omitted.

<Details about an Installation Structure>

The inner rotor 52 may be installed on the outer shaft 72 in such a way to be not shifted with respect to the outer shaft 72 without contacting the outer bearings 74.

Figure 23:
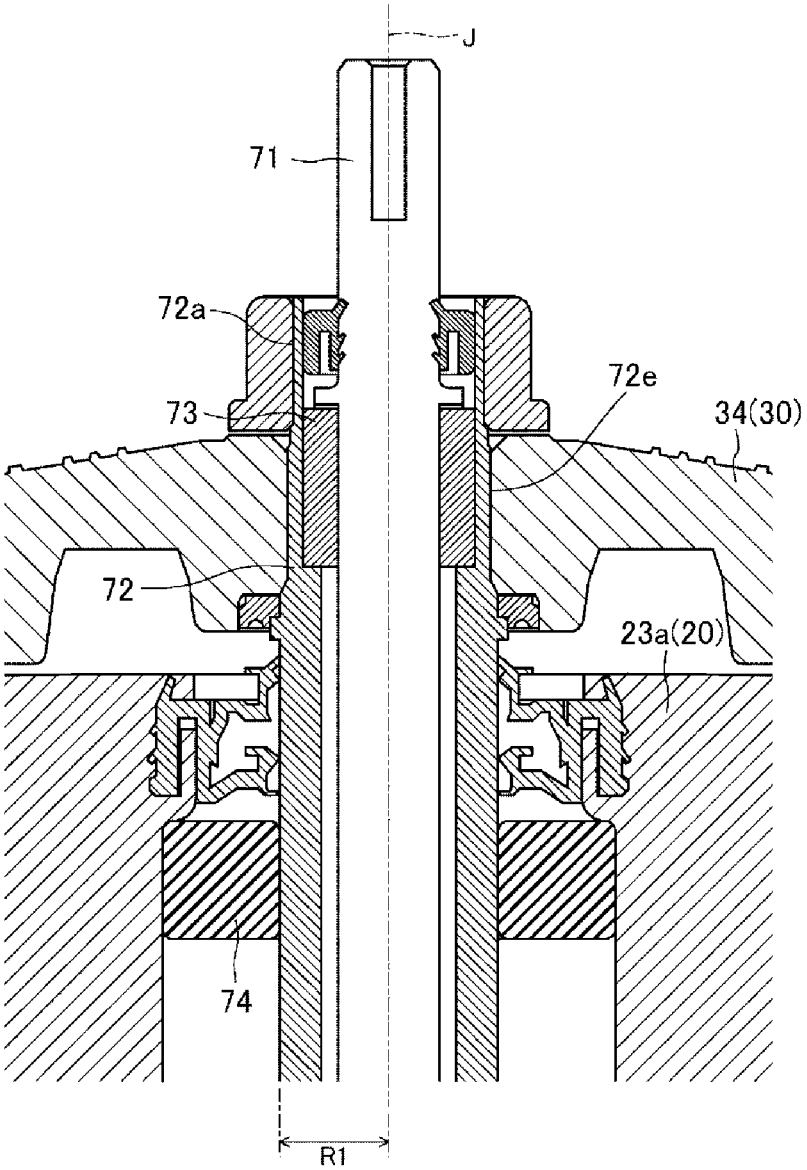
FIG. 23 is an enlarged longitudinal sectional view showing an upper portion of a double shaft.

As shown in FIG. 23, the outer shaft 72 may be formed such that an external diameter R1 of a part 72*c* axially supported by the outer bearing 74 located close to the drum 30 is equal to an external diameter R2 of a part 72*d* axially supported by the outer bearing 74 (ball bearing 74) located distant from the drum 30.

The outer shaft 72 may be configured with a single member (a single part), not with a combination of a plurality of members.

Figure 25:
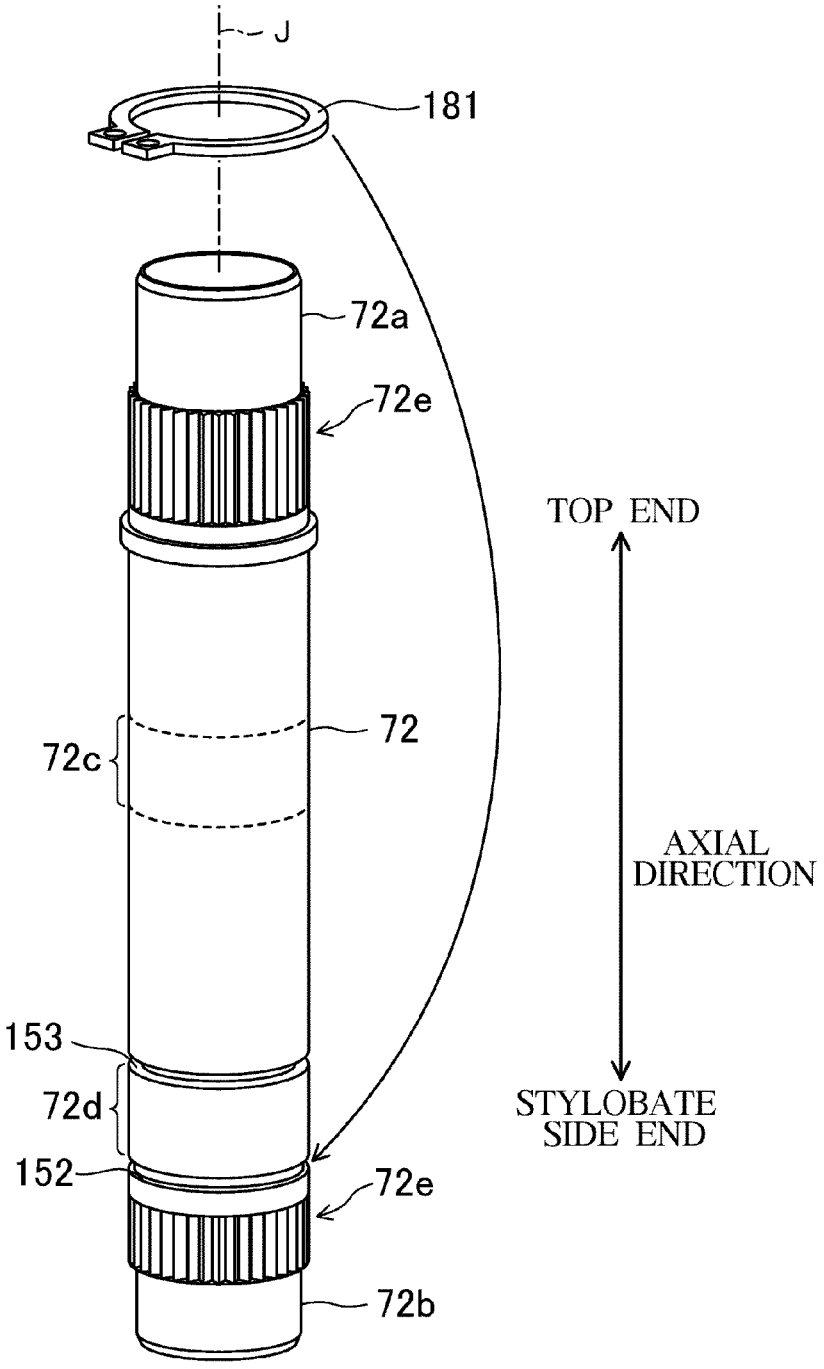
FIG. 25 is an exploded perspective view showing an installation structure of a retaining ring with respect to an outer shaft.

As shown in FIG. 25, installation portions 72*e* having inserting parts whose outer circumferential surfaces are subject to serration may be formed respectively around a top end 72*a* of the outer shaft 72 toward the drum 30 and around a stylobate side end 72*b* of the outer shaft 72 that is opposite to the drum 30. The shaft hole of the inner rotor 52 may be inserted into the installation portion 72*e* formed around the stylobate side end 72*b* so that the inner rotor 52 may be installed on the outer shaft 72.

Figure 24:
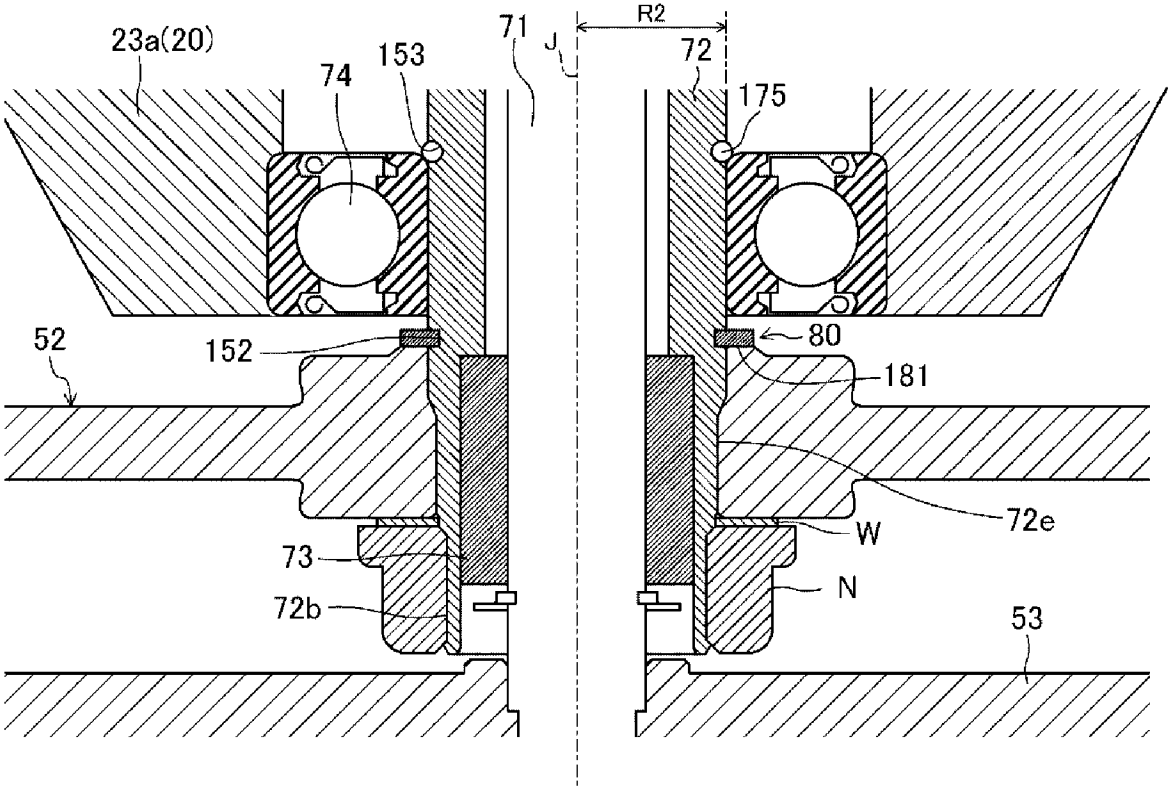
FIG. 24 is an enlarged longitudinal sectional view showing a lower portion of a double shaft.

Also, by coupling a nut N with the stylobate side end 72*b* of the outer shaft 72, the inner rotor 52 may be installed and fixed on the outer shaft 72, as shown in FIG. 24. Also, between a lower surface of the outer shaft 72 and an upper surface of the nut N, a washer W for preventing the nut N from being loosened may be inserted and fixed.

On an outer circumferential surface of the stylobate side end 72*b* of the outer shaft 72, two grooves 152 and 153 may be formed concavely at an interval along the circumferential direction.

As shown in FIG. 24, a rubber ring 175 may be inserted in the groove 153 located close to the top end. The rubber ring 175 may contact the top end of the ball bearing 74.

In the groove 152 located close to the stylobate side end 72*b*, a snap ring 181 may be inserted. The snap ring 181 may be a so-called C type snap ring, and formed in a C-shaped form as seen from above. When the snap ring 181 is fitted into and fixed in the groove 152, the snap ring 181 may protrude outward from the outer circumferential surface of the outer shaft 72, and forma contact portion 80. That is, the snap ring 181 may have a larger width than a depth of the groove 152.

Between the ball bearing 74 and the contact portion 80 formed by the snap ring 181, a predetermined gap may be formed in the axial direction.

When the outer shaft 72 is inserted in the inner rotor 52, the inner rotor 52 may contact the contact portion 80, and the inner rotor 52 may be fitted and supported between the contact portion 80 and the nut N in the state in which the nut N is coupled with the outer shaft 72.

(Modified Example)

Figure 26:
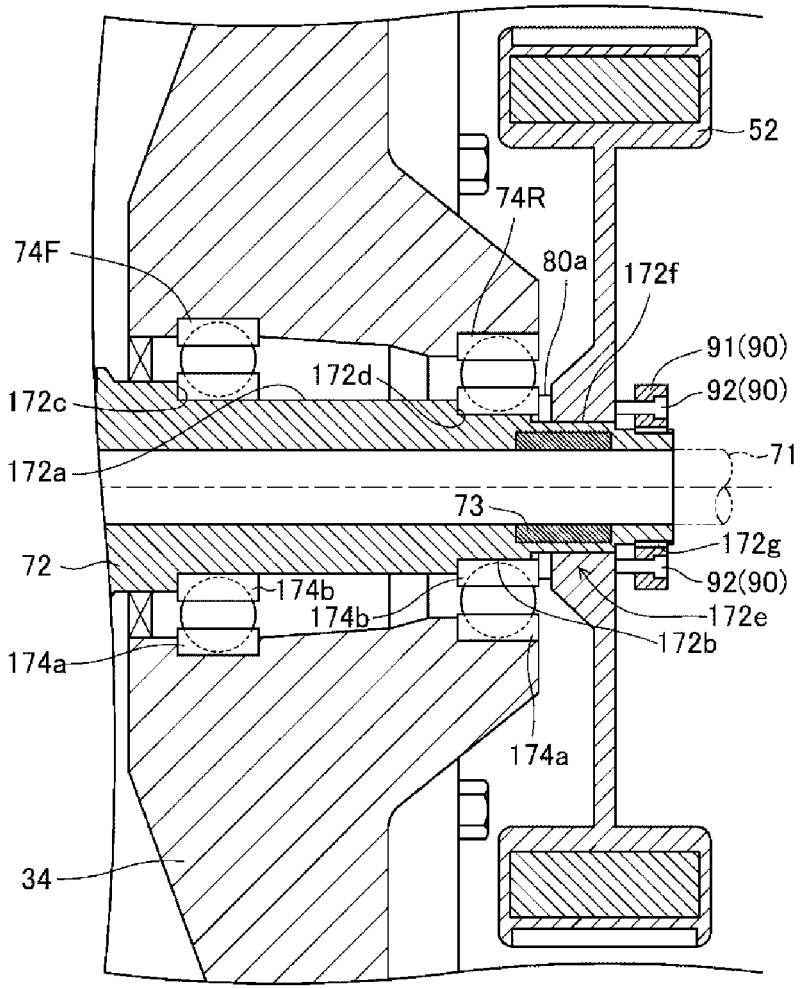
FIG. 26 is a schematic cross-sectional view showing a main portion of a double shaft according to Modified Example.
Figure 27:
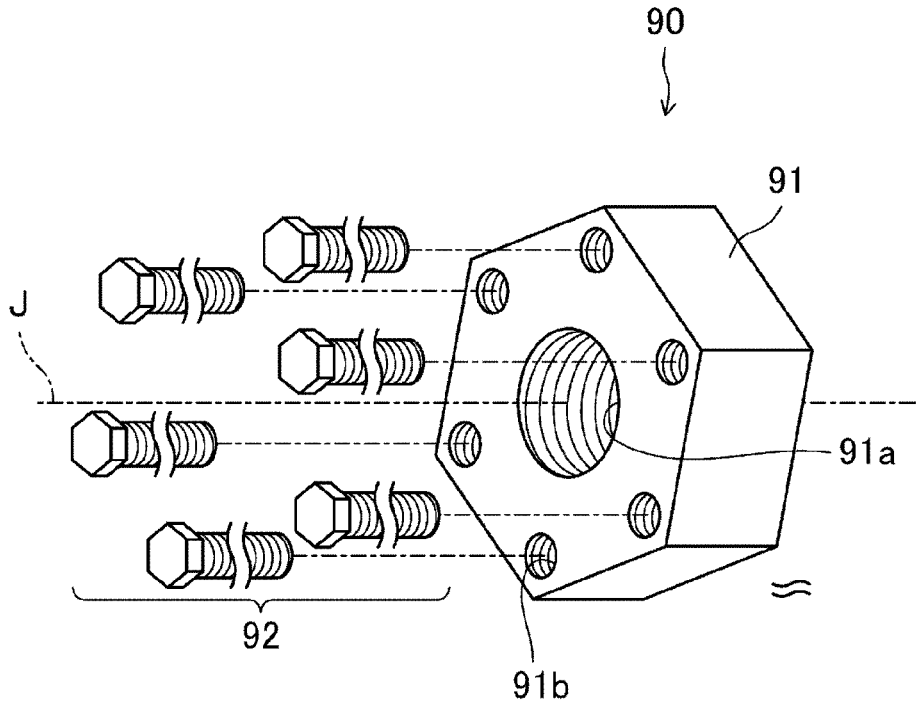
FIG. 27 is a schematic perspective view showing a fixture.

FIGS. 26 and 27 show a modified example of an installation structure the inner rotor 52 that is installed on the outer shaft 72.

As described above, the outer shaft 72 may be rotatably supported on the bearing housing 23*a* through the two outer bearings 74 spaced in the axial direction on the shaft support 24.

In the modified example, the outer bearing 74 (outer lace 174*a*) may be pressed and fixed in the bearing housing 23*a*, and the outer shaft 72 may be loosely fitted in the outer bearing 74 (inner lace 174*b*).

The front outer bearing 74 (front bearing 74F) among the outer bearings 74 may be a bearing having excellent support stability, which is larger than the rear outer bearing 74 (rear bearing 74R). Since a greater load is applied to the front bearing 74F than to the rear bearing 74R, the front bearing 74F may be relatively larger than the rear bearing 74R for stable supporting and for suppressing vibrations or noise.

The front end of the outer shaft 72 may protrude forward from the shaft support 24, and be located in the inside of the tub 20. At the front end of the outer shaft 72, the drum 30 may be installed through the flange shaft 34. Between the front end of the outer shaft 72 and the flange shaft 34, a rotation preventing structure configured with a serration or formed by concave-convex fitting may be installed, and the outer shaft 72 and the flange shaft 34 may be fixed not so as to rotate.

Thereby, at the front end of the inner shaft 71 protruding to the inside of the drum 30, the pulsator 40 may be fixed so as not to rotate through the rotation preventing structure not so as to rotate, like the outer shaft 72.

Meanwhile, the rear end of the outer shaft 72 may protrude rearward from the shaft support 24, and by inserting the rear end of the outer shaft 72 into the shaft hole of the inner rotor 52, the inner rotor 52 may be connected to the outer shaft 72. Also, by inserting the rear end of the inner shaft 71 protruding from the rear end of the outer shaft 72 to the shaft hole of the outer rotor 53, the outer rotor 53 may be connected to the inner shaft 71.

The double shaft 70 may be installed in the shaft support 24 by inserting the outer shaft 72 into the shaft support 24 at which the outer bearings 74 are fixed. Therefore, as shown in FIG. 26, an internal diameter of the front bearing 74F may be larger than or equal to an internal diameter of the rear bearing 74R. In correspondence to this, the outer shaft 72 may include, at the main body between the front end and the rear end, a great diameter portion 172*a* having an external diameter and fitted (loosely fitted) in the front bearing 74F, and a small diameter portion 172*b* having a smaller external diameter than that of the great diameter portion 172*a* and fitted (loosely fitted) in the rear bearing 74R. The great diameter portion 172*a* may extend from the front end of the small diameter portion 172*b*.

The front end of the outer shaft 72, which is a rear end in an insertion direction, may have a greater external diameter than that of the great diameter portion 172*a*, and at a border of the front end and the great diameter portion 172*a*, a front step 172*c* may be formed in the shape of a circular ring to prevent the outer shaft 72 from moving rearward. Also, at the border of the great diameter portion 172*a* and the small diameter portion 172*b*, a rear step 172*d* may be formed in the shape of a circular ring to prevent the outer shaft 72 from moving rearward.

The front bearing 74F may contact the front step 172*c*, and the rear bearing 74R may contact the rear step 172*d* so that the outer shaft 72 may be positioned on the shaft support 24.

Also, the rear end (also referred to as a rotor connecting end 172*e*) of the outer shaft 72, which is a front end in the insertion direction, may be formed with a smaller external diameter than that of the small diameter portion 172*b*, since the rear end of the outer shaft 72 requires a smaller external diameter than that of the small diameter portion 172*b*. Since the rotor connecting end 172*e* has a smaller external diameter than that of the small diameter portion 172*b*, the outer shaft 72 may be easily inserted into the rear bearing 74R or the front bearing 74F, resulting in excellent workability.

Since the outer shaft 72 is supported on the shaft support 24 in this manner, a space retaining ring 80*a*, the inner rotor 52, and a fixture 90 may be installed at the rotor connecting end 172*e* protruding rearward from the shaft support 24.

More specifically, an installing portion 172*f* extending from the small diameter portion 172*b* and having a rotation preventing structure may be installed at the rotor connecting end 172*e*. The shaft hole of the inner rotor 52 may be removably inserted into the installing portion so that the inner rotor 52 may be installed through the space retaining ring 80*a*.

The space retaining ring 80*a* may be a thick metal ring having an external diameter contacting the inner lace 174*b* of the rear bearing 74R without contacting the outer lace 174*a* of the rear bearing 74R, and the space retaining ring 80*a* may be installed in the installing portion 172*f* earlier than the inner rotor 52. The inner rotor 52 may be installed in the installing portion 172*f* through the space retaining ring 80*a*. Accordingly, the inner rotor 52 may be rotatably supported on the bearing housing 23*a*, together with the outer shaft 72.

At a part protruding from the installing portion 172*f* of the rotor connecting end 172*e*, a male screw portion 172*a* in which a male screw is formed along the circumference may be formed. The fixture 90 may be coupled with the male screw portion 172*a* and fixed.

As shown in FIG. 27, the fixture 90 may include a fixing base portion 91 having a female screw portion 91*a* in which a female screw that is inserted into the male screw portion 172*a* is formed, and a plurality of fixing rods 92 (in the current embodiment, 6 fixing rods) arranged around the female screw portion 91*a*. In the fixing base portion 91, a plurality of rod holes 91*b* may be formed at equidistant intervals around the female screw portion 91*a* in such a way to extend in parallel to the female screw portion 91*a*, and the fixing rods 92 may be installed in the rod holes 91*b*.

In the circumference of each fixing rod 92, a male screw may be formed, and in each rod hole 91*b*, a female screw may be formed into which the male screw is inserted. Accordingly, the fixing rod 92 may slide along the rotation axis J.

Accordingly, by screwing the fixing rods 92 into the rod holes 91*b*, a compression force may be applied to the inner rotor 52 from the outside (the protruding end of the rotor connecting end 172*e*) in axial direction, and the inner rotor 52 may be pressed to the space retaining ring 80*a* to be fixed on the outer shaft 72.

Since the inner rotor 52 is fixed by being pressed firmly at a plurality of locations, supporting strength may be improved, and positional shifting or loosening in the axial direction may be prevented, while suppressing vibrations or noise. Also, since the inner rotor 52 is pressed firmly at a plurality of locations spaced around the shaft, support stability may also be excellent. Also, since the inner rotor 52 is supported at equidistant intervals, support stability may be further excellent.

Since the press-fit pressure of the individual fixing rods 92 can be adjusted, support balance of high precision may be secured, and loosening may be, if occurs, easily adjusted.

<Application Example of Washing Machine>

In a full automatic washing machine, washing operation, rinsing operation, and dehydrating operation may be performed successively. In the above-described washing machine of Patent Document 3, since the rotating tub and the stirring body rotate at different rpms or in different directions, the motor for rotating them requires a motor output according to the state.

For example, in washing operation or rinsing operation, since washing water, as well as laundry, is also accommodated in the rotating tub, the motor for driving the rotating tub and the stirring body requires high torque. Meanwhile, in dehydrating operation in which washing water is removed, the motor requires a high-speed rotation although it does not require high torque. Also, in washing operation or rinsing operation, operation of changing the rotation directions or rpms of the rotating tub and the stirring body to increase movements of laundry may be performed. However, in dehydrating operation, the rotating tub and the stirring body are generally driven together at the same rpm in the same direction.

Also, when a process of changing the magnetization amount of the magnets installed in the rotor and changing the output performance of the motor according to operation is performed, large magnetizing current needs to be supplied to the motor upon magnetization.

Therefore, to stably operate the washing machine that rotates the rotating tub and the stirring body simultaneously through a shaft of a double shaft structure, it may be preferable to supply a high supply voltage. However, since general household washing machines use a commercial supply voltage of the rated output, there is the upper limit. Also, since there are some foreign regions where a commercial supply voltage is unstable, it may be necessary to stably operate washing machines even in such regions in order to distribute the washing machines all over the world.

Accordingly, a washing machine according to Application Example may be configured to stably drive the motor for rotating the rotating tub and the stirring body with different supply voltages through the shaft of the double shaft structure, so that the washing machine can be used all over the world.

(Basic Configuration of Present Washing Machine)

Figure 8:
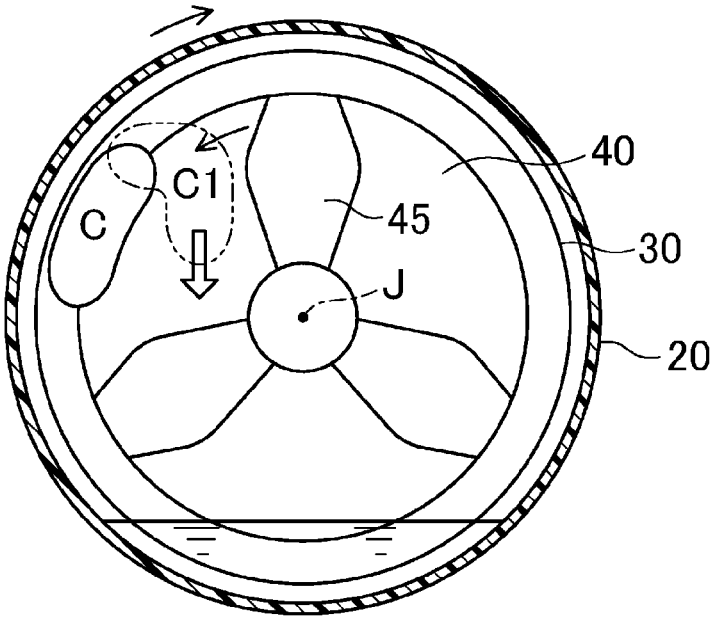
FIG. 8 is a view for describing a washing method.

The washing machine may have the same configuration as the washing machine 1 shown in FIG. 1. Likewise, the washing machine may use, as shown in FIG. 7 or 8, the washing method of rotating the drum 30 and the pulsator 40 in different directions to effectively provide combined mechanical power to laundry. Accordingly, the same components as the corresponding ones of the washing machine 1 will be assigned the same reference numerals, and detailed descriptions thereof will be omitted.

However, the washing machine 1 is designed for home use, and connected to the rated commercial alternating-current power of 100V, 200V, etc. Also, although the washing machine 1 is configured to be used all over the world, there are some countries or regions where the commercial supply voltages are unstable. For this reason, the washing machine 1 is designed to be stably used even with different rated commercial alternating-current voltages or unstable commercial alternating-current voltages.

The controller 60 may control magnetization of the motor 50 that is performed according to driving states of the drum 30 and the pulsator 40 in each operation.

Figure 28:
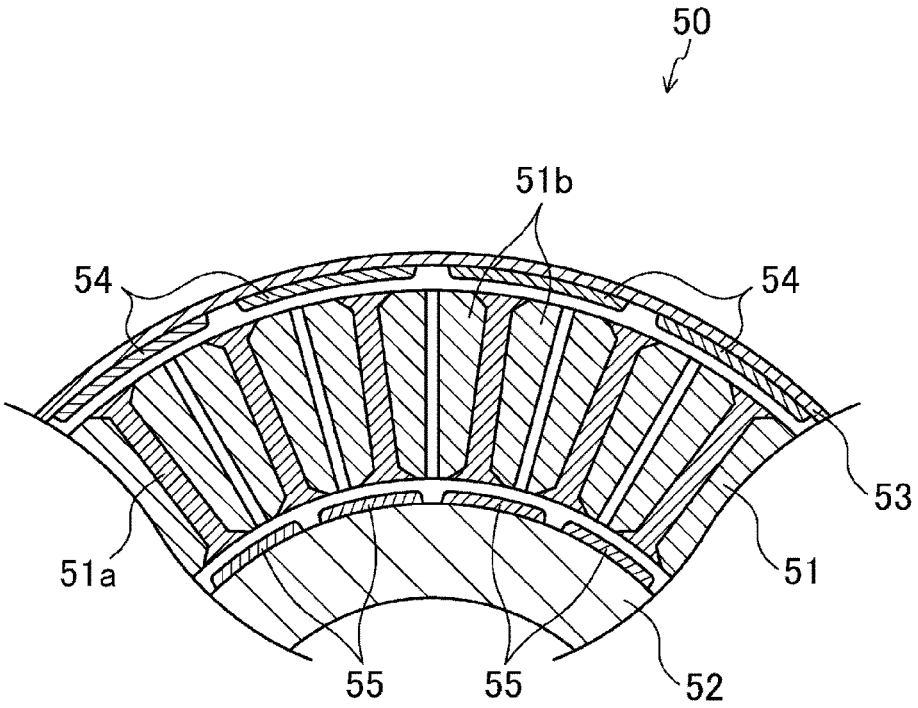
FIG. 28 is a schematic cross-sectional view showing a main portion of a motor in a washing machine according to Application Example.

As shown in FIG. 28, the stator 51 may include a stator core 51*a* configured by stacking metal plates, and a plurality of coils 51*b* configured by winding wires around the stator core 51*a* and arranged at equidistant intervals in the circumferential direction of the stator 51. The stator 51 may be mounted on the rear surface of the bearing housing 23*a* of the tub 20.

The outer rotor 53 may be a cylindrical member having a flat bottom, and on the inner circumferential surface of the outer rotor 53 facing the stator 51, a plurality of magnets 54 may be arranged at equidistant intervals as a plurality of rectangular plates such that magnetic poles (N pole and S pole) appear alternately in the circumferential direction. The magnets 54 may be alnico magnets (magnetization-corresponding magnets 54), wherein the magnetization state may change, that is, the directions of poles or a magnetization amount may be reversible by magnetization.

The inner rotor 52 may be a flat member having a smaller external diameter than the outer rotor 53, and on the outer circumferential surface of the inner rotor 52 facing the stator 51, a plurality of magnets 55 may be arranged at equidistant intervals as a plurality of rectangular plates such that magnetic poles (N pole and S pole) appear alternately in the circumferential direction. Unlike the outer rotor 53, the magnets 55 may be neodym magnets (magnetization ratio-corresponding magnets 55) having a high coercive force, whose magnetized state does not change.

(Power Circuit 80')

Figure 29:
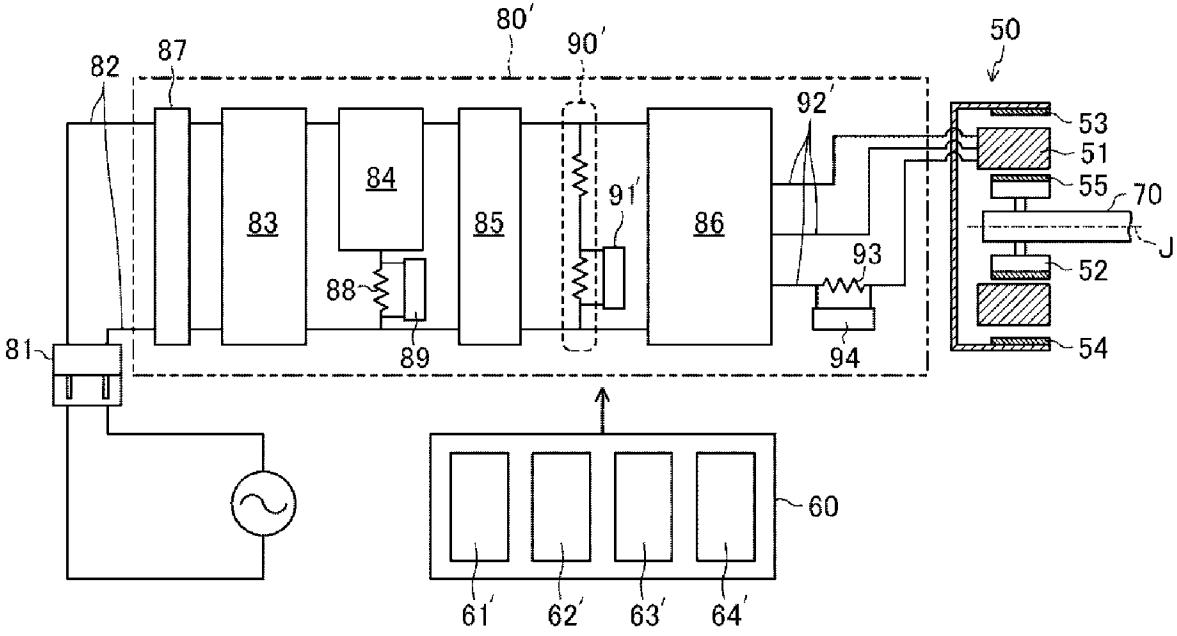
FIG. 29 is a block diagram showing a power circuit in a washing machine according to Application Example.

The motor 50 may include a power circuit 80' that is driven by power supplied from an external commercial alternating-current power source. As shown in FIG. 29, one terminal of the power circuit 80' may be connected to a pair of electrical cables 82 having an outlet 81, and electrically connected to the external commercial alternating-current power source through a plug. The motor 50 may be supplied power through the power circuit 80'.

The power circuit 80' may be configured with a rectifier circuit 83, a booster circuit 84, a capacitor 85, an inverter circuit 86, etc., which are connected in series to the pair of electrical cables 82. The power circuit 80' may supply predetermined controlled complex currents (three-phase and six-phase currents coexist) to the motor 50 under the control of the controller 60.

The rectifier circuit 83 may be a general circuit configured with a bridge rectifier circuit, etc. and disposed at the power source side of the power circuit 80'. A commercial alternating-current voltage may be rectified by the rectifier circuit 83 to generate a direct-current voltage. In the power circuit 80', an alternating-current phase detecting device 87 may be installed closer to the power source side than the rectifier circuit 83. The alternating-current phase detecting device 87 may detect a phase of the commercial alternating-current voltage.

The booster circuit 84 may be a general circuit capable of boosting the direct-current voltage rectified by the rectifier circuit 83, and may be configured with a reactor, a short circuit, etc. The booster circuit 84 may be installed closer to the motor side than the rectifier circuit 83. Between the booster circuit 84 and one of the electrical cables 82, a first current detecting resistor 88 and a first current detecting device 89 may be installed. The first current detecting device 89 may detect an amount of current flowing to the booster circuit 84 from a voltage of both ends of the first current detecting resistor 88.

Since the booster circuit 84 boosts a supplied voltage, the booster circuit 84 may supply a constant voltage stably to the inverter circuit 86, even when the rated output of the commercial supply voltage is lower than a voltage required for driving the motor 50, or when the commercial alternating-current voltage is unstable and lower than the voltage required for driving the motor 50.

Also, by installing the booster circuit 84, another supply voltage that is output to the motor may also be adjusted to a constant voltage, so that a worldwide correspondence is possible in response to the rated outputs of 100 V and 200 V, resulting in an improvement in convenience of the washing machine 1.

Also, the booster circuit 84 may function as a power-factor correction circuit to improve a power factor.

Also, since the upper limit of the maximum rpm of the motor is limited by a supply voltage, the maximum rpm of the motor may be raised by boosting.

The capacitor 85 may be a general member having an electricity storage function, and may be installed between the booster circuit 84 and the inverter circuit 86. A voltage that is supplied to the inverter circuit 86 may be stabilized by the capacitor 85. A voltage detecting resistance 90' and a voltage detecting device 91' may be connected to a terminal of the capacitor 85 close to the motor. The voltage detecting device 91' may detect a voltage boosted by the booster circuit 84.

The inverter circuit 86 may be disposed close to the motor 50 in the power circuit 80', and connected to the stator 51 of the motor 50 through three output cables 92'. In the inverter circuit 86, a second current detecting resistor 93 and a second current detecting device 94 may be installed. More specifically, as conceptually shown in FIG. 7, the second current detecting resistor 93 may be installed on an output path of any one of the output cables 92', and the second current detecting device 94 may detect current flowing to the inverter circuit 86 from a voltage of both ends of the second current detecting resistor 93.

The inverter circuit 86 may adjust a waveform of power (current) based on the control of the controller 60, and output a complex current to the motor 50. The outer rotor 53 and the inner rotor 52 may be driven independently by the complex current.

The power circuit 80' may be controlled by the controller 60. The controller 60 may include a timer 61' for controlling an output frequency of the booster circuit 84, a boosting amount decider 62' for calculating and deciding an output amount of the booster circuit 86, an inverter output decider 63' for calculating and deciding an output amount of the inverter circuit 86, and a magnetization controller 64'.

For example, a voltage that is output to the motor 50 according to a driving state of the motor 50 in each operation, such as washing operation, rinsing operation, and dehydrating operation, may be adjusted by the control of the power circuit 80' by the controller 60. That is, an optimal voltage for a driving pattern of each operation may be set in advance, and the boosting amount decider 62' may decide an output amount of the booster circuit 84 based on a voltage value detected by the voltage detecting device 91' such that whenever a driving pattern of each operation changes, a supply voltage changes to the corresponding set voltage.

Also, the booster circuit 84 may function as a power-factor correction circuit. That is, the boosting amount decider 62' may decide an output amount of the booster circuit 84 to improve distortion of current and improve a power factor, based on a phase of power detected by the alternating-current phase detecting device 87, a voltage value detected by the voltage detecting device 91', and a current value detected by the second current detecting device 94.

Also, to improve output efficiency, a switching frequency of the booster circuit 84 may change by the timer 61' according to an output amount of the booster circuit 84 decided by the boosting amount decider 62'. That is, to improve output efficiency, a switching frequency may be changed to a high value or a low value according to a change of an output amount of the booster circuit 84 to improve output efficiency.

(Magnetization)

In the washing machine 1, the motor 50 may be magnetized according to a driving state of the drum 30 and the pulsator 40 in each operation by the control of the magnetization controller 64'.

That is, since the washing machine 1 generates a complex current with the single inverter circuit 86 to control rotations of the inner rotor 52 and the outer rotor 53 of the motor 50, a magnetization state of at least any ones (in the washing machine, the magnetization-corresponding magnets 54) of the magnets 54 and 55 of the inner rotor 52 and the outer rotor 53 may need to change to control the rotation directions independently.

For example, to change rotation directions of the drum 30 and the pulsator 40 from the same direction to opposite directions or from the opposite directions to the same direction, it may be necessary to change the magnetic poles (N pole and S pole) of the magnetization-corresponding magnets 54.

Also, since washing water as well as laundry is accommodated in the drum 30 in washing operation or rinsing operation, the drum 30 or the pulsator 40 may need high torque for rotation. Therefore, the magnetization-corresponding magnets 54 may require a high magnetic force. In contrast, in dehydrating operation, the drum 30 or the pulsator 40 may not need high torque for rotation, however, may require high-speed rotations. The high magnetic force of the magnetization-corresponding magnets 54, the greater rotation resistance upon high-speed rotations, which causes energy loss, noise, and vibrations. Therefore, it may be preferable that the magnetic force of the magnetization-corresponding magnets 54 is low.

For this reason, the washing machine 1 may be set to execute, before washing operation, a process of reversing the magnetic poles of the magnetization-corresponding magnets 54 to rotate the drum 30 and the pulsator 40 in opposite directions by magnetizing the motor 50 through the controller 60 or a process of increasing a magnetization amount of the magnetization-corresponding magnets 54 to obtain high torque of the outer rotor 53. Also, when the rotation directions change during washing operation, a process of reversing the magnetic poles may be executed.

Also, the controller 60 may be set to execute, before dehydrating operation, a process of reversing the magnetic poles of the magnetization-corresponding magnets 54 to rotate the drum 30 and the pulsator 40 in the same direction by magnetizing the motor 50 or a process of reducing a magnetization amount of the magnetization-corresponding magnets 54. When the rotation directions change during rinsing operation before dehydrating operation, a process of reversing the magnetic poles may be executed, and before dehydrating operation, a demagnetization process may be executed.

Upon magnetization, a large magnetizing current in the shape of pulses may need to be supplied to the motor 50. Therefore, there are many cases in which a voltage (magnetization voltage) required for supplying the magnetizing current is not obtained only with a commercial supply voltage. For this reason, in such cases, the magnetization controller 64' of the washing machine 1 may boost a voltage through the booster circuit 84 to obtain the magnetization voltage.

More specifically, the boosting amount decider 62' may decide an output amount of the booster circuit 84 to cause a predetermined magnetization current to flow based on a current value detected by the second current detecting device 94 upon magnetization, or to make a magnetization voltage constant based on a voltage detected by voltage detecting device 91'.

Also, magnetization timing may be controlled to efficiently supply power required for magnetization.

Figure 30:
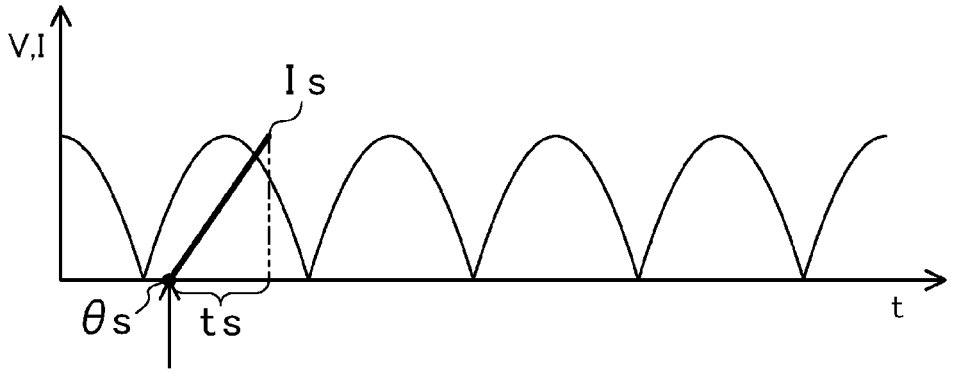
FIG. 30 is a view for describing a generation timing of magnetizing current in a washing machine according to Application Example.

That is, after rectifying by the rectifier circuit 83, a voltage of a waveform (full-wave rectification waveform) appearing successively at predetermined cycles may be output as shown by a thin solid line in FIG. 30. Since a large magnetizing current is output in the shape of pulses upon magnetization, a difference in efficiency with respect to the voltage waveform may be made by timing at which the magnetizing current is supplied.

Accordingly, in the washing machine 1, to perform magnetization at optimal timing by the magnetization controller 64', a magnetizing current may be generated according to the phase of a voltage, as shown by a thick solid line in FIG. 30. More specifically, as shown by an arrow of FIG. 30, at timing at which a phase detected by the alternating-current phase detecting device 87 is identical to a reference phase θs, a magnetizing current may start being supplied, and the inverter output decider 63' may decide an output amount of the inverter circuit 86 such that a current detected by the second current detecting device 94 reaches a reference current value Is at a reference time ts. Also, the reference phase θs, the reference time ts, and the reference current value Is may have been set n advance by the magnetization controller 64'.

Accordingly, since the washing machine 1 stably drives the motor 50 for rotating the drum 30 and the pulsator 40 through the double shaft 70 even with different supply voltages, the washing machine 1 may be widely used all over the world.

Also, the washing machine according to Application Example is a washing machine using a single dual motor 50, however, the washing machine may use typical two motors, instead of the dual motor 50.

More specifically, two motors each having a single rotor in the inside or outside of a single stator, that is, two inner rotor type motors or two outer rotor type motors may be used instead of the dual motor 50.

For example, the dual motor 50 may be replaced with a motor in which two stators are configured with a two-layered double stator structure in which two stators are positioned in inside and outside relations and an inner rotor and an outer rotor are respectively disposed in the inside and outside of the double stator structure. The motor may be functionally the same as two independent motors arranged in parallel around the rotation axis J. Also, two general motors may be installed.

Also, in the power circuit 80', two inverter circuits, instead of the inverter circuit 86, may be installed in parallel, and the inverter circuits may drive the motors individually. In this case, since it is possible to rotate the drum 30 and the pulsator 40 individually, magnetization control may not be needed. Also, since the two inverter circuits are used, the power circuit 80' may be complicated. However, since the motors are general motors, the motors can be easily procured.

<Another Embodiment>

The current embodiment is an example of application to a top loading type washing machine.

Figure 31:
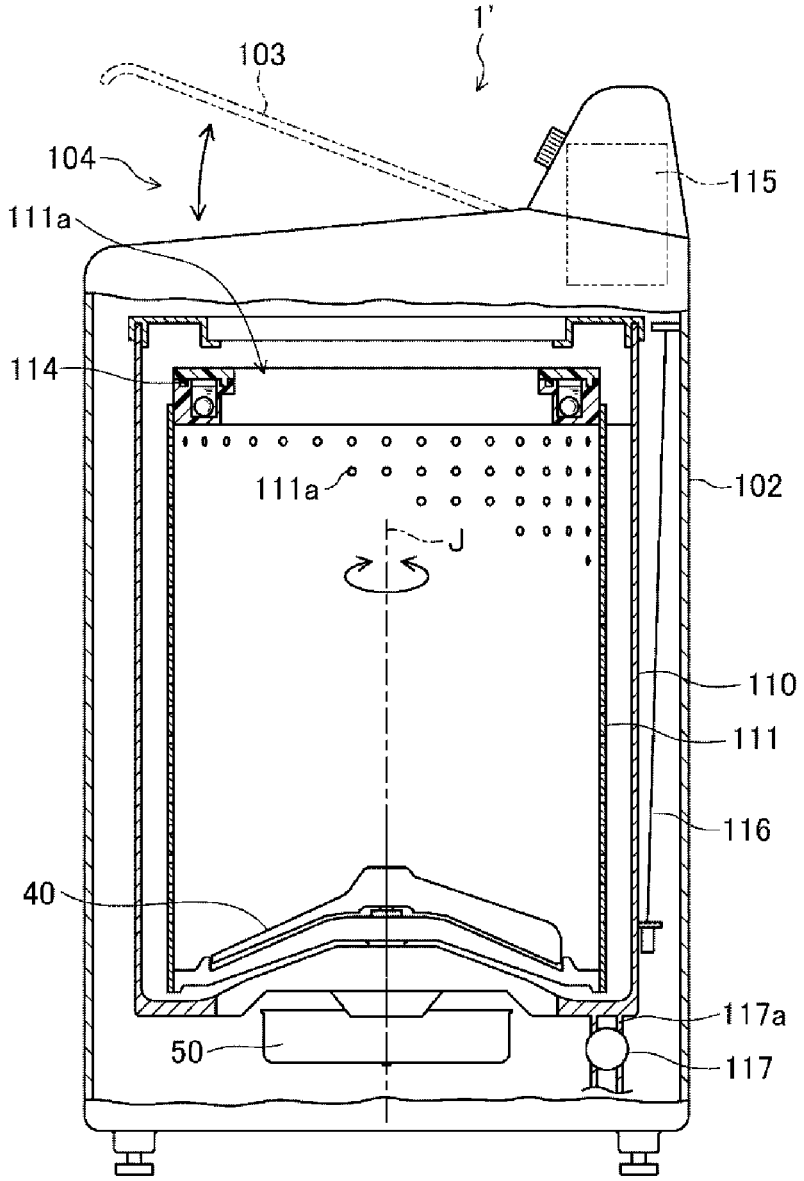
FIG. 31 is a schematic view showing Application Example applied to a top loading type washing machine.

FIG. 31 shows a washing machine 1' according to the current embodiment. The washing machine 1' may be a full-automatic washing machine. The washing machine 1' may have a housing 102 formed in the shape of a rectangular box standing in a longitudinal direction, wherein an opening 104 is formed in a top of the housing 102 and opened and closed by a cover 103. Laundry may be put into or taken out of the washing machine 1' through the opening 104. Various switches or display that is controlled by a user may be provided behind the opening 104.

In the inside of the housing 102, a tub 110, a drum 11, a motor 50, a pulsator 40, a balancer 114, a controller 115, etc. may be installed. The tub 110 may be a cylindrical container which has a bottom and in which water may be stored, and the tub 110 may be suspended on the inner wall of the housing 102 by a plurality of suspension devices 116 in the state in which an opening of the tub 110 is toward the opening 104. The inside of the tub 110 may be filled with water through a water feeding mechanism (not shown). The bottom of the tub 110 may be connected to a drain pipe 117 that is opened or closed by a valve 117*a*, and used water may be drained to the outside of the washing machine 1' through the drain pipe 117.

The drum 111 may be a cylindrical container which is significantly smaller than the tub 110 and which has a bottom to accommodate laundry. The drum 111 may be accommodated in the tub 110 in the state of being rotatable on a vertical axis J extending in a straight line, wherein the opening of the drum 111 is toward the opening 104. Laundry may be processed in the inside of the drum 111. In a cylindrical side wall of the drum 111, a plurality of drain holes 111*a* may be formed throughout the cylindrical side wall (some of the drain holes 111*a* are shown in the drawing).

Around the opening of the drum 111, a balancer 114 may be installed. The balancer 114 may be a member formed in the shape of a circular ring and accommodating a plurality of balls or viscous fluid therein. The balancer 114 may adjust unbalance in weight caused by a non-uniform distribution of laundry when the drum 111 rotates.

On the bottom of the drum 111, the pulsator 40 may be installed, and on the bottom of the tub 110, the motor 50 may be installed.

Since the washing machine 1' performs washing with a small amount of washing water and combines the mechanical power of the drum 111 with mechanical power of the protruding portion of the pulsator 40 to apply the combined mechanical power to laundry, the washing machine 1' can obtain effects of beating washing and rubbing washing through movements of laundry, like drum type washing machines, although the typical effect of kneading washing is not obtained. Furthermore, since the laundry is mixed, stains can be reduced. Accordingly, it may be possible to improve washing power or to reduce a washing time.

The invention claimed is:

1. A front-loading washing machine comprising:

a housing having an opening through which laundry is put into or taken out of the housing;

a tub positioned in an inside of the housing, and storing washing water;

a drum rotatably positioned in an inside of the tub; and a pulsator positioned in an inside of the drum, and configured to be rotatable with respect to the drum and having a disc portion, and a protrusion extending in a radial direction of the disc portion;

a driving device configured to rotate the drum and the pulsator; and a processor configured to:

during a washing operation, control the driving device to rotate the drum so that the laundry is pressed on an inner circumferential wall of the drum by a centrifugal force, during washing operation, control the driving device to rotate the pulsator in a direction that is opposite to a rotation direction of the drum to collide the protrusion with the laundry pressed on the inner circumferential wall of the drum on an upper portion of the drum.

2. The front-loading washing machine of claim 1, wherein during the washing operation, the processor is further configured to control the driving device to rotate the pulsator at higher rotational speed than a rotational speed of the drum.

3. The front-loading washing machine of claim 1, wherein the driving device comprises:

a stator;

an inner rotor positioned in an inside of the stator;

an outer rotor positioned in an outside of the stator; and an inverter configured to control the inner rotor and the outer rotor.

4. The front-loading washing machine of claim 3, wherein:

the stator comprises a plurality of I-shaped teeth arranged in a radial shape and a plurality of coils wound around the plurality of I-shaped teeth, and when current flows to a coil, a magnetic pole of a part of teeth adjacent to the inner rotor is opposite to a magnetic pole of a part of teeth adjacent to the outer rotor.

5. The front-loading washing machine of claim 3, wherein a number of magnetic poles of at least one of the inner rotor and the outer rotor is converted according to changes of the magnetic poles by magnetization.

6. The front-loading washing machine of claim 3, wherein:

one of the drum and the pulsator is connected to the inner rotor, and another one of the drum and the pulsator is connected to the outer rotor.

7. The front-loading washing machine of claim 6, further comprising a double shaft connecting the driving device to the drum and the pulsator, wherein the double shaft comprises:

an outer shaft connecting the drum to the inner rotor, and having a cavity therein; and an inner shaft connecting the pulsator to the outer rotor, and rotatably inserted in an inside of the cavity.

8. The front-loading washing machine of claim 1, wherein a height of the protrusion from the disc portion increases toward a circumferential part of the disc portion from a center part of the disc portion.

9. The front-loading washing machine of claim 8, wherein:

in the pulsator, an outer circumferential surface of the protrusion is spaced from an inner circumferential surface of the drum, such that a gap is made between the outer circumferential surface of the protrusion and the inner circumferential surface of the drum, and the gap includes a functional surface contacting the laundry and applying a force to the laundry.

10. The front-loading washing machine of claim 9, wherein when a maximum height of the protrusion is H and a distance between the outer circumferential surface of the protrusion and the inner circumferential surface of the drum is ΔR, the H and the ΔR satisfy equation: $0.5 \leq H/\Delta R \leq 1.0$.

11. The front-loading washing machine of claim 8, wherein the disc portion on which the protrusion is formed includes an inclined surface inclined downward from the center part of the disc portion toward the circumferential part of the disc portion.

12. The front-loading washing machine of claim 8, wherein:

the pulsator comprises a boss portion located in the center part of the disc portion and connected to a shaft serving as a rotation axis, and the boss portion is formed of material that is different from material forming the disc portion.

13. The front-loading washing machine of claim 1, wherein during dehydrating operation, the processor is further configured to control the driving device to rotate the pulsator in the same direction as a rotation direction of the drum.

* * * * *